US009206607B2

(12) United States Patent
Schopf et al.

(10) Patent No.: US 9,206,607 B2
(45) Date of Patent: Dec. 8, 2015

(54) CLAMPS FOR PANELS

(76) Inventors: John Schopf, Thornbury (AU); Manfred Schopf, Thornbury (AU)

( * ) Notice: Subject to any disclaimer, the term of this patent is extended or adjusted under 35 U.S.C. 154(b) by 0 days.

(21) Appl. No.: 13/321,715

(22) PCT Filed: May 19, 2010

(86) PCT No.: PCT/IB2010/002113

§ 371 (c)(1),
(2), (4) Date: Jun. 6, 2012

(87) PCT Pub. No.: WO2010/146474

PCT Pub. Date: Dec. 23, 2010

(65) Prior Publication Data

US 2012/0261631 A1 Oct. 18, 2012

(30) Foreign Application Priority Data

May 19, 2009 (AU) ..... 2009902253
Jun. 18, 2009 (WO) ..... PCT/IB2009/006858

(51) Int. Cl.
*E04F 11/18* (2006.01)

(52) U.S. Cl.
CPC ..... *E04F 11/1851* (2013.01)

(58) Field of Classification Search
CPC ..... E04F 11/1851; E04H 17/16; E06B 3/00; E06B 3/02; E06B 3/5454; E06B 3/5864
USPC ..... 256/1, 24, 25, 31, 67; 52/204.72, 52/204.65; 403/355
See application file for complete search history.

(56) References Cited

U.S. PATENT DOCUMENTS

| | | | | |
|---|---|---|---|---|
| 3,121,261 | A | 2/1964 | Ritter, Jr. | |
| 3,254,885 | A * | 6/1966 | Rumsey | 267/120 |
| 3,317,228 | A * | 5/1967 | Storch | 403/388 |
| 4,054,268 | A * | 10/1977 | Sher | 256/24 |
| 4,067,548 | A * | 1/1978 | Murphy | 256/24 |
| 4,103,874 | A * | 8/1978 | Horgan, Jr. | 256/24 |
| 4,236,363 | A * | 12/1980 | Vinther et al. | 52/281 |
| 4,671,016 | A * | 6/1987 | Boeckx | 49/501 |
| 4,920,717 | A * | 5/1990 | Hooper, Jr. | 52/204.597 |
| 5,207,037 | A | 5/1993 | Giles et al. | |
| 6,434,905 | B1 * | 8/2002 | Sprague | 52/474 |
| 6,912,818 | B2 * | 7/2005 | Sprague | 52/208 |
| 7,036,799 | B2 * | 5/2006 | Shepherd | 256/73 |
| 7,963,077 | B2 * | 6/2011 | Lin | 52/204.597 |

FOREIGN PATENT DOCUMENTS

FR 77730 E * 4/1962

* cited by examiner

*Primary Examiner* — Daniel Wiley
(74) *Attorney, Agent, or Firm* — Hogan Lovells LLP

(57) ABSTRACT

A clamp securable to an edge of a panel at an edge thereof is disclosed. The clamp comprises two clamping members that are drawn together when an elongate locating component is advanced into a space between two formations comprised in the clamping members. The formations hook around the locating component from opposite sides so that as the locating component pushes them apart, the clamping members are drawn together. Contact between the clamping members fixes the distance between clamping surfaces of the clamping members, between which the panel is held.

10 Claims, 23 Drawing Sheets

FIG. 3
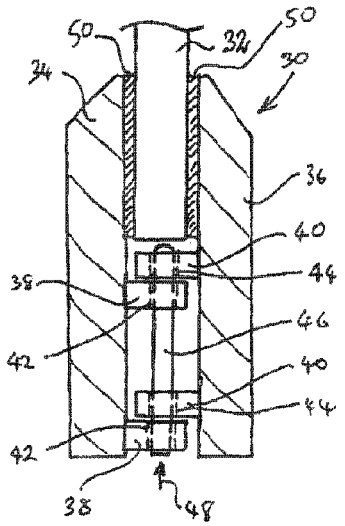
FIG. 2
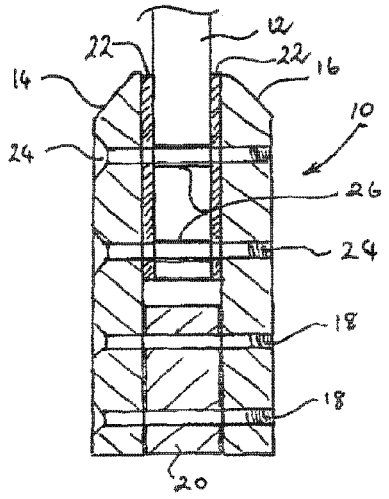
PRIOR ART
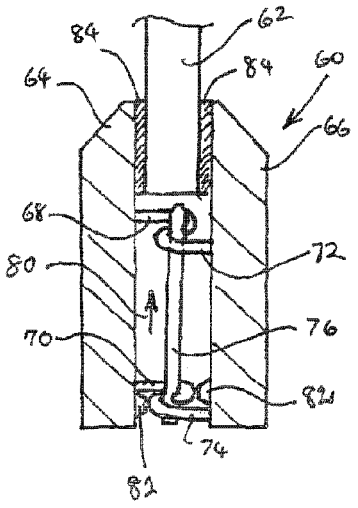
FIG. 4
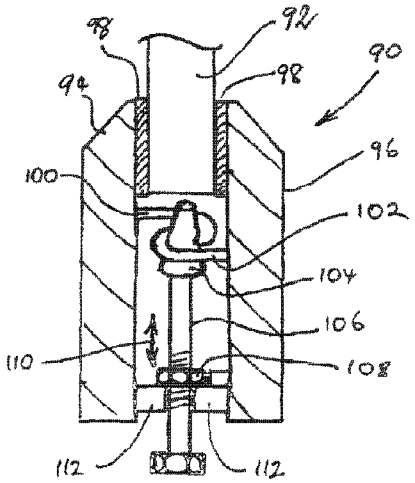
FIG. 5

FIG. 11
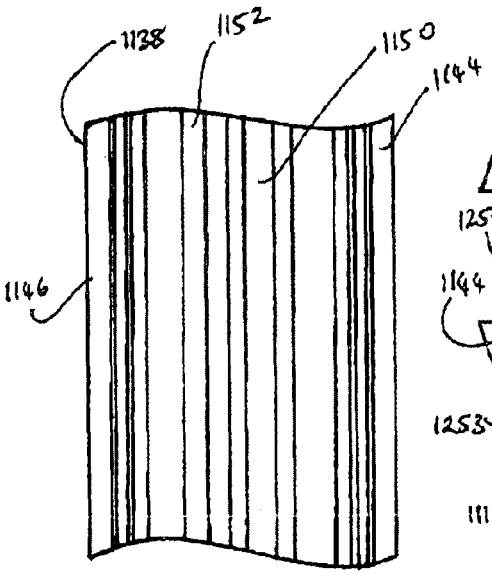
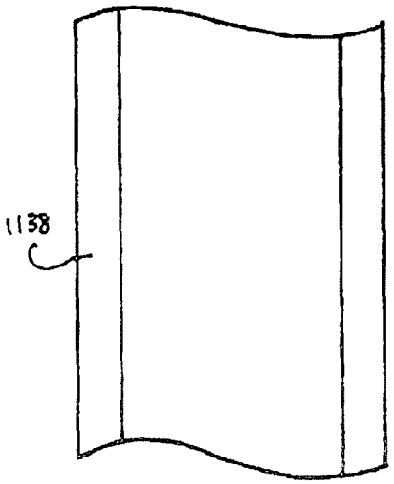
FIG. 10
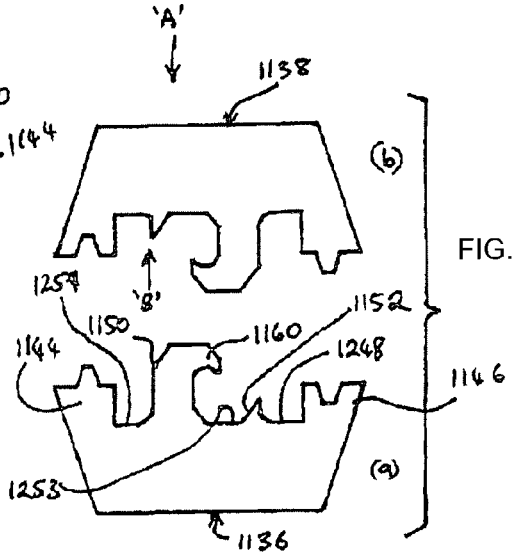
FIG. 9
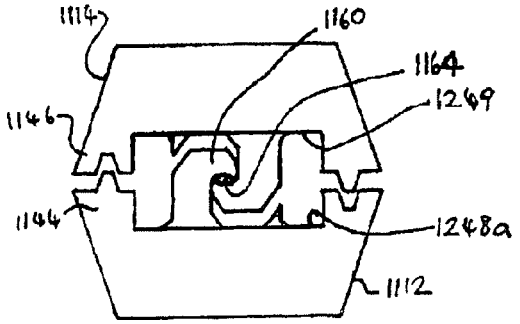
FIG. 12
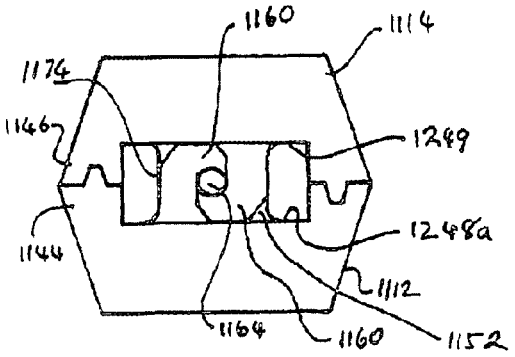
FIG. 13

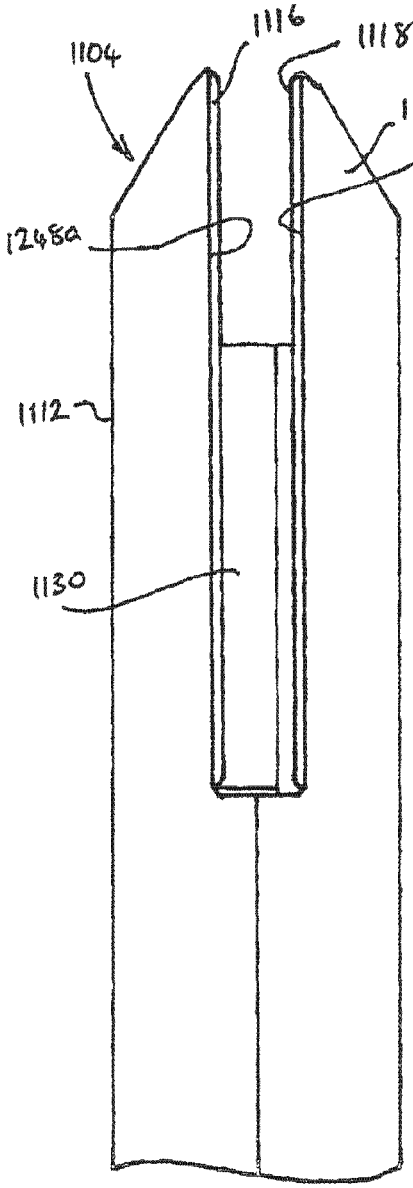
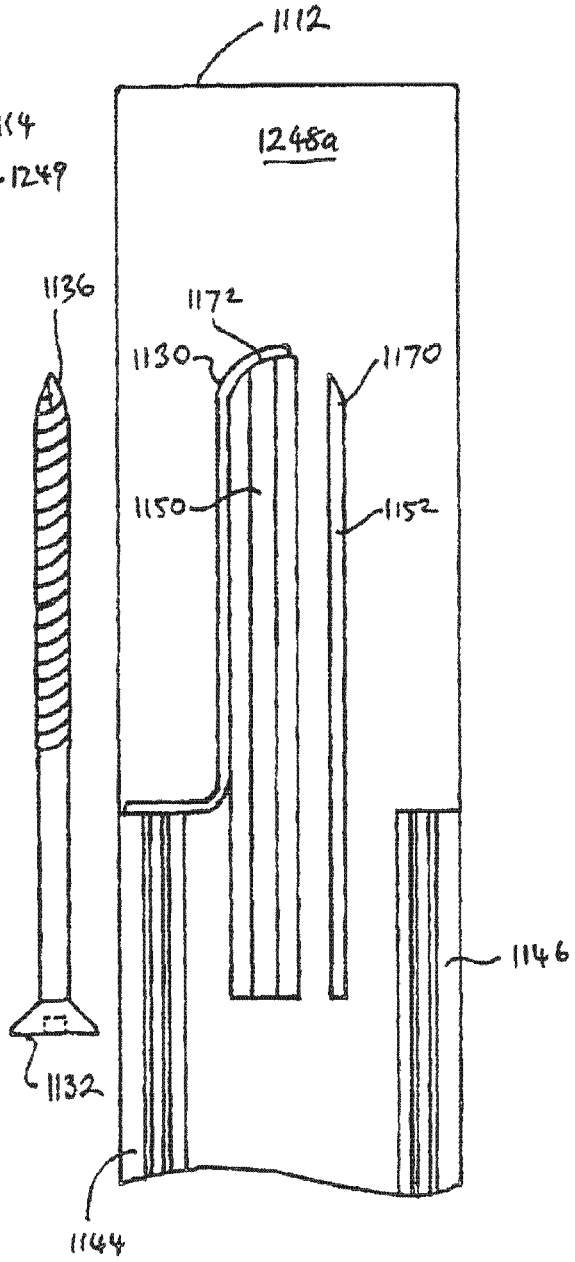
FIG. 16
FIG. 15

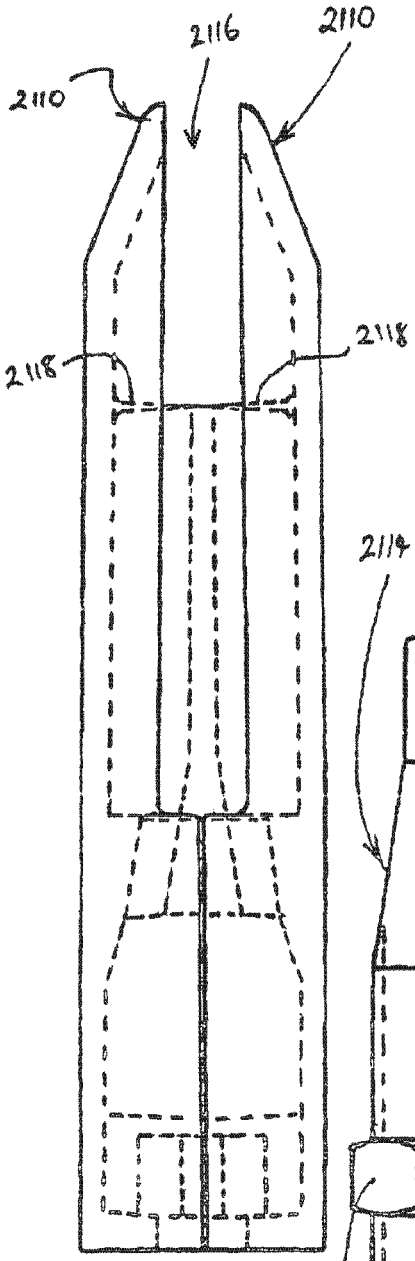
FIG. 26
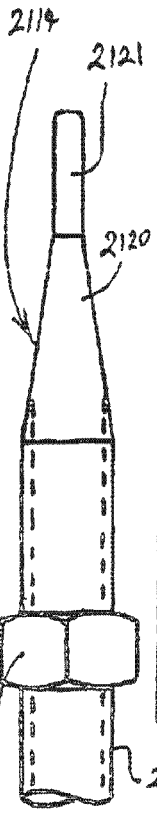
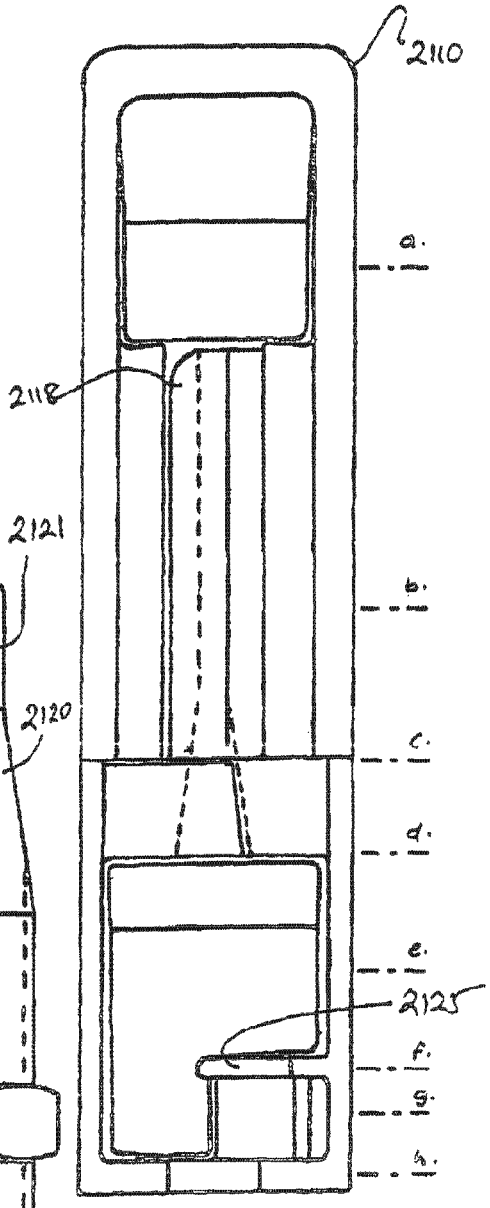
FIG. 27
FIG. 28

FIG. 32
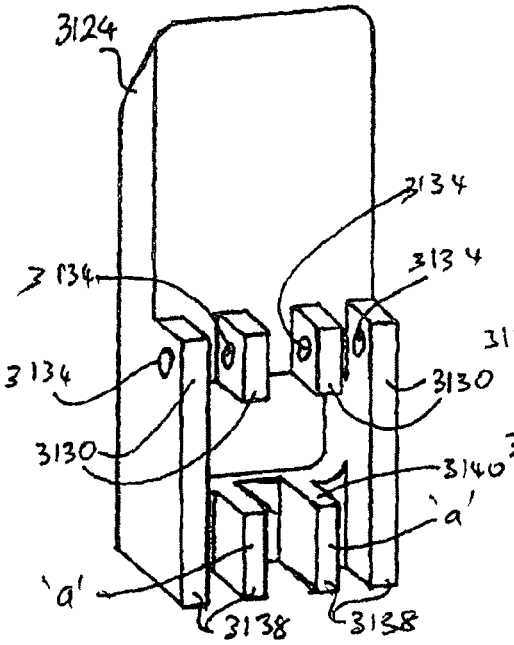
FIG. 33
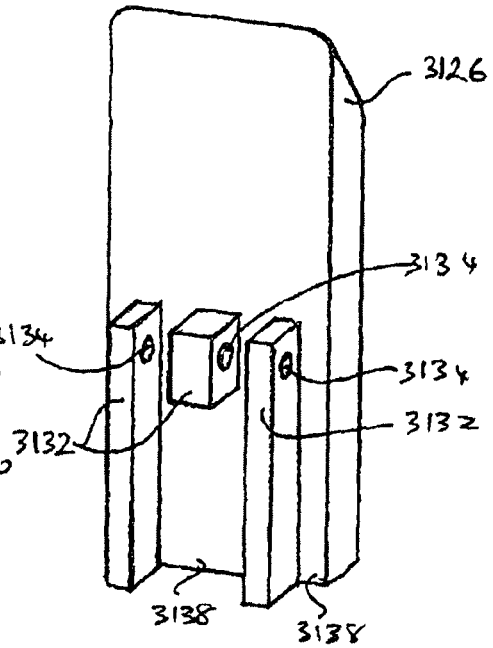
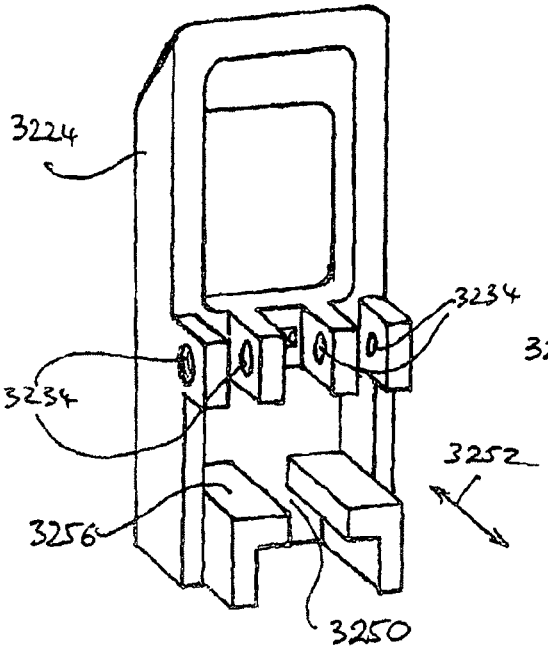
FIG. 34
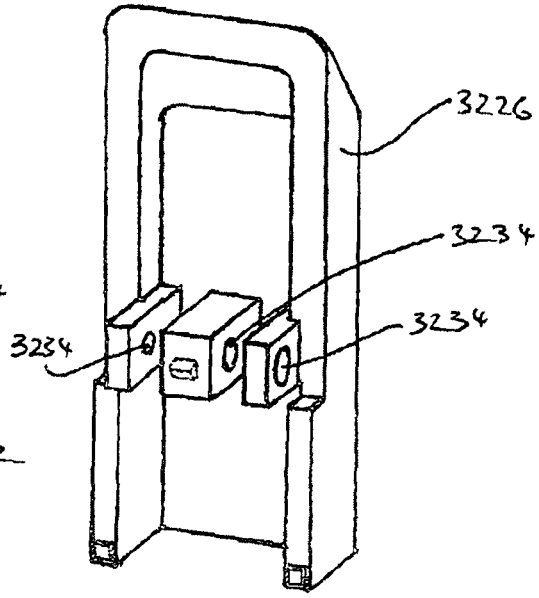
FIG. 35

FIG. 36
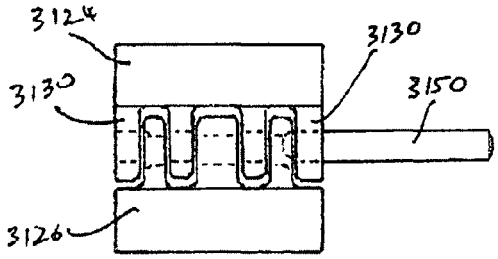
FIG. 37
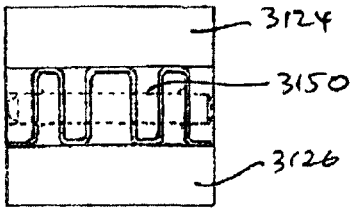
FIG. 38
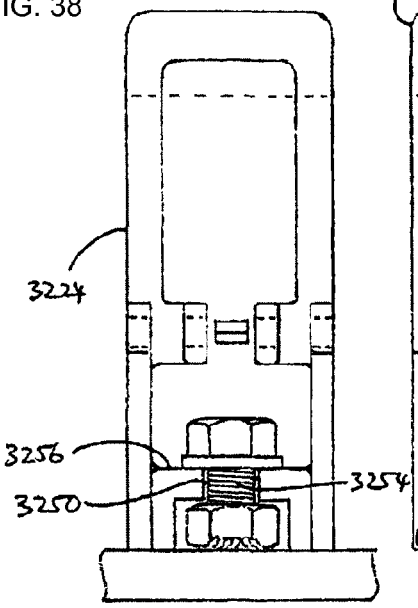
FIG. 39
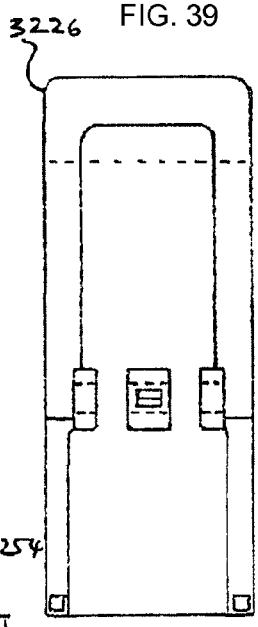
FIG. 40
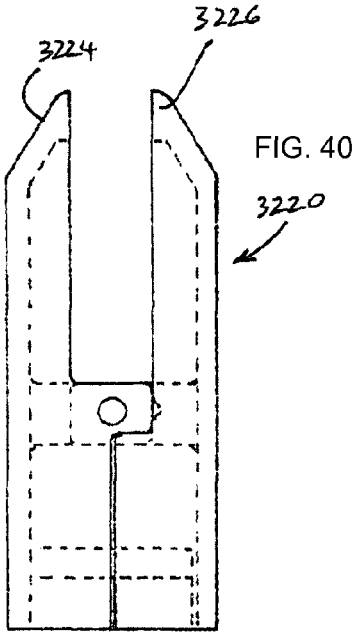
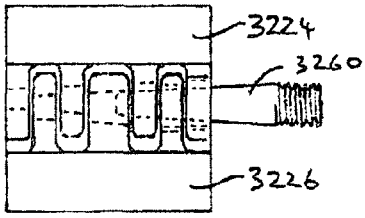
FIG. 41
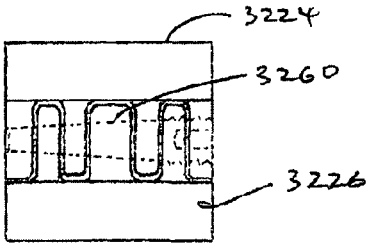
FIG. 42

CLAMPS FOR PANELS

This application is a U.S. National Phase under 35 U.S.C. §371 of International Application PCT/IB2010/002113, filed on May 19, 2010, which claims priority upon International Application PCT/IB2009/006858, filed on Jun. 18, 2009, which claims priority upon Australian Application 2009902253, filed on May 19, 2009; the contents of which are all herein incorporated by this reference in their entireties. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

FIELD OF THE INVENTION

The invention described here relates to improved clamps for panels, with particular reference to clamps for use in fences and barriers.

BACKGROUND

FIG. 1 is a perspective view of a portion of a fence 1 that comprises a plurality of panels 2 arranged end-to-end with small gaps 3 therebetween, each panel being held in a vertical plane by two clamps 4, with clamps 4 being set into a supporting surface 5. Fences of this type, typically with panels 2 being made of glass or a transparent plastic (for example those sold under the trade marks Lexan and Perspex), are widely used as security fences for swimming pools, to mark boundaries of eating areas of restaurants and in like applications. They have sometimes been used as balustrades on buildings.

The appearance and the speed and ease of erection of fence 1 are dependent in part on the design of the panel-supporting clamps 4, as of course is the structural integrity and safety of fence 1. Several clamps applicable to such fences, and to certain other fences also, are described below. These are believed to be useful additions to the choices available to designers, when judged by the combination of appearance, erection ease and speed, and by the safety and integrity they offer.

A particular advantage of the clamps disclosed herein is that they can avoid or limit the obtrusive sight of fasteners on the clamps' exteriors. By way of example, a prior art clamp having externally visible fasteners is disclosed by Austin in International Patent Publication No. WO03/091516.

Other advantages are provided by clamps according to the invention, reasonable ease and speed of assembly and in some embodiments the ability to manufacture using metal extrusions.

SUMMARY OF THE INVENTION

According to the invention there is provided a clamp for connecting a panel-shaped element to a ground mass or a structural element, comprising first and second clamping members that in use of the clamp each apply a force to one of two opposing faces of a panel-shaped element, whereby to clamp the panel shaped element therebetween.

More particularly, there is provided a clamp securable to a panel at an edge thereof said clamp comprising:

a first clamping means comprising a first clamping surface;

a second clamping means comprising a second clamping surface; and a locating component, wherein said first and second clamping means and said locating component in use interlock with each other so that said first clamping surface and said second clamping surface are positioned to press respectively against opposing faces of a panel positioned therebetween.

Preferably, at least one of the clamping means comprises cushioning means that in use of the clamp is compressed between a face of the panel and a remaining portion of that clamping means so as to press against both said face of the panel and said remaining portion of that clamping means. Particularly if cushioning means are provided for contact with both sides of the panel, this reduces the chances of damage to the panel. This is important for example in the case of glass panels.

In one class of clamps embodying the invention, said first clamping means has a first surface that faces generally in a direction opposite to the first clamping surface and said second clamping means has a first surface that faces generally in a direction opposite to the second clamping surface so that urging apart of said first surfaces urges the clamping surfaces of the clamping means towards each other; and said locating component is sized and shaped to in use of the clamp press against said first surfaces so as to urge said first and second clamping faces against opposing faces of the panel therebetween.

A said first surface may be a surface of a wave-shaped or hook-shaped formation of the clamping means in which it is comprised.

The locating component may be movable through a range of positions relative to said first surfaces until a final position is reached which position is characterized in that the locking component and the clamping means are held in fixed positions relative to each other.

Said first surfaces may be substantially conical and said locating component may comprise a substantially conical surface.

To provide adjustment, said locating component may be threadably engageable in one of the clamping means or in a nut further comprised in said clamp and positioning of said locating component may be variable by rotation of said locating component.

Said locating component may be engageable in a nut comprised in said clamp with said nut being held captive and prevented from rotating in a cavity defined by and between said first and second clamping means.

Said plurality of positions may be spaced apart along an axis that in use of the clamp lies approximately in the plane of the panel and perpendicular to an edge of the panel to which edge the clamp is secured.

In preferred embodiments, movement of the locking component into the final position requires movement of the locking component generally inwardly into the clamp.

In a preferred embodiment the following applies:

said first and second clamping means are generally elongate and each has a first portion in which its said clamping surface is comprised and a second portion in which its said first surface is comprised;

in each said second portion said first surface is longitudinally spaced apart from a second surface, the first surfaces being closer to the first portion than the second surfaces; and in the clamp when assembled said second surfaces abut each other or said locating component, whereby to act as a fulcrum for relative movement of said first and second clamping means.

If adjustability is not considered important, or can be provided by for example varying the thickness of cushion material abutting the panel face(s), another arrangement may be used, wherein said first and second clamping means and said locating component are so shaped that when they are assembled together the first clamping surface is placed and maintained in one only fixed position relative to the second clamping surface.

The locating component may be elongate and extend generally longitudinally in the clamp (i.e. in a direction that is vertical when the clamp is used to support a horizontal lower edge of a panel).

The locating component may comprise one of a screw-threaded member and a member of constant cross-section along at least a portion of its length.

Alternatively, the locating component may be elongate and extend at least approximately in a direction parallel to a panel edge at which the clamp is secured to the panel. Like versions where the locating component extends vertically, this arrangement can provide an appearance better than conventional clamps using bolts or screws that extend perpendicularly to the panel plane.

In use of the clamp a second surface of the first clamping means may abut a second surface of the second clamping means at a location on the second portion longitudinally spaced apart from said locating component whereby the locating component acts as a fulcrum and forces applied to the first and second clamping surfaces by the panel clamped therebetween are balanced by contact forces between the second surfaces.

Still another class of clamps according to the invention can be used where adjustability is not required. In this form:

the said first and second clamping means are generally elongate and each has a first portion in which it's said clamping surface is comprised and a second portion;

each of said first and second clamping means comprises a set of openings spaced apart on a common axis;

in the clamp when assembled the common axes of the first and second clamping means coincide with each other; and the locating component passes through the said holes whereby to hold the first and second clamping means together with the first and second clamping surfaces in a fixed position relative to each other.

The said common axes when the clamp is assembled may extend generally longitudinally of the clamp. During assembly of such a clamp, the locating component may be placed in position by movement in a longitudinal direction into an end of the second portion.

Alternatively, the said common axes when the clamp is assembled may extend at least approximately parallel to a panel edge at which the clamp is secured to the panel.

In clamps that are adjustable as mentioned above, the locating component may also be elongate and in use extend in a direction at least approximately parallel to a panel edge at which the clamp is secured to the panel, with the same appearance advantage as for the non-adjustable clamps mentioned above.

In use of the clamp a second surface of the first clamping means may abut a second surface of the second clamping means at a location on the second portion longitudinally spaced apart from said common axes whereby the locating component acts as a fulcrum and forces applied to the first and second clamping surfaces by the panel clamped therebetween are balanced by contact forces between the second surfaces.

It will be shown herein that in some embodiments of the invention, at least one of the first and second clamping means comprises a metal extrusion of which portions have been machined away.

In some of these, each of the first and second clamping means comprises a metal extrusion of which portions have been machined away and the same extrusion is used for both the first and second clamping means.

The invention further provides a fence or barrier (such as a swimming pool fence or a balustrade or other panel-based barrier) comprising at least one panel supported above a substrate or structure by at least one clamp as disclosed herein secured to a lower edge of the panel.

There is also provided a fence or barrier further comprising a railing assembly secured to an upper edge of the panel by at least one clamp as disclosed herein secured to the upper edge of the panel.

The invention still further provides a method for securing a panel to a component or substrate comprising the steps of:

providing first and second clamping means and a locating component for a clamp according to any one of the forms disclosed herein; and assembling the clamp to an edge of the panel and to said component or substrate.

It is believed that clamps according to the invention have significant advantages for installers in their ease of installation and adjustability (in applicable cases) and for owners in the performance and appearance.

Other inventive aspects features and refinements of the invention are set out below in the following detailed description and in the claims and diagrams.

Everywhere in this specification, including in the appended claims, the word "comprise" and derivatives such as "comprising" and "comprise" when used in relation to a set of elements integers features or steps are to be taken to indicate that the elements integers features or steps are present, but are not to be taken to preclude the possibility of other elements integers features or steps being present also.

Preferred embodiments of the inventions will be further described in the following detailed description, by reference to the attached Figures, of which:

FIG. 2 is a schematic cross-section, taken on a plane perpendicular to the plane of a panel, of that panel and a prior art clamp secured thereto;

FIG. 3 is a schematic cross-section, taken on a plane perpendicular to the plane of a panel, of that panel and a first clamp according to this invention secured thereto;

FIG. 4 is a schematic cross-section, taken on a plane perpendicular to the plane of a panel, of that panel and a second clamp according to this invention secured thereto;

FIG. 5 is a schematic cross-section, taken on a plane perpendicular to the plane of a panel, of that panel and a third clamp according to this invention secured thereto;

FIG. 9 is an end view of two elongate elements usable to make parts of the clamp of FIG. 8;

FIG. 10 is a view of a portion of an element shown in FIG. 9 looking in the direction of arrow "A";

FIG. 11 is a view of a portion of an element shown in FIG. 9 looking in the direction of arrow "B";

FIG. 12 is an end view of two parts of the clamp of FIG. 8 partially interlocking with each other;

FIG. 13 is an end view of two parts of the clamp of FIG. 8 interlocking with each other and with a further component;

FIG. 15 is an elevation of part of the clamp part shown in FIG. 14 looking in the direction of arrow "D" with a screw beside it in the screw's correct longitudinal position, for comparison;

FIG. 16 is a side view of portion of the assembled clamp of FIG. 8;

Figure 23:
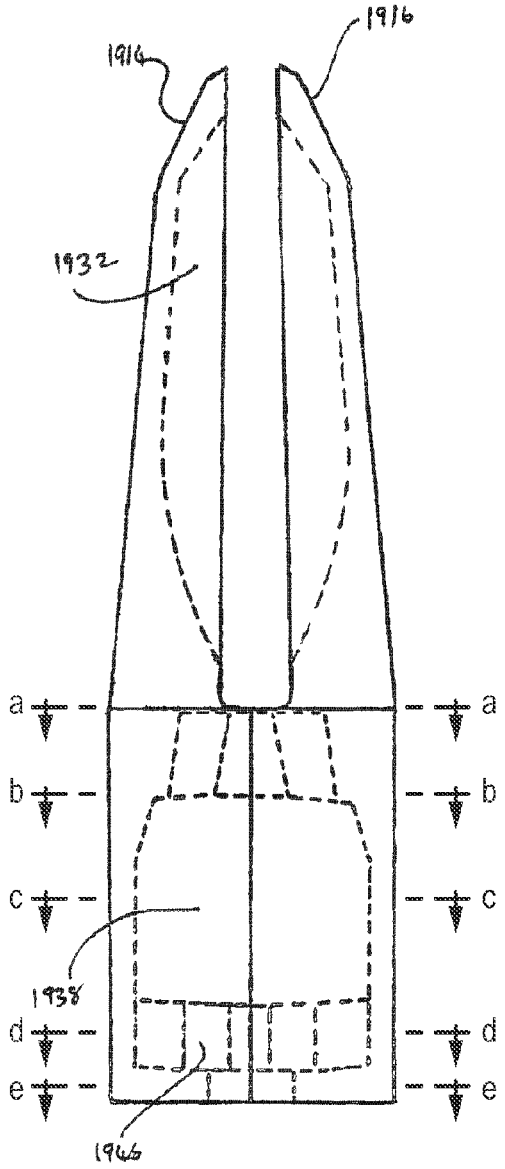
FIG. 23 is a side view of the clamp shown in FIG. 20, showing hidden lines.
Figure 24:
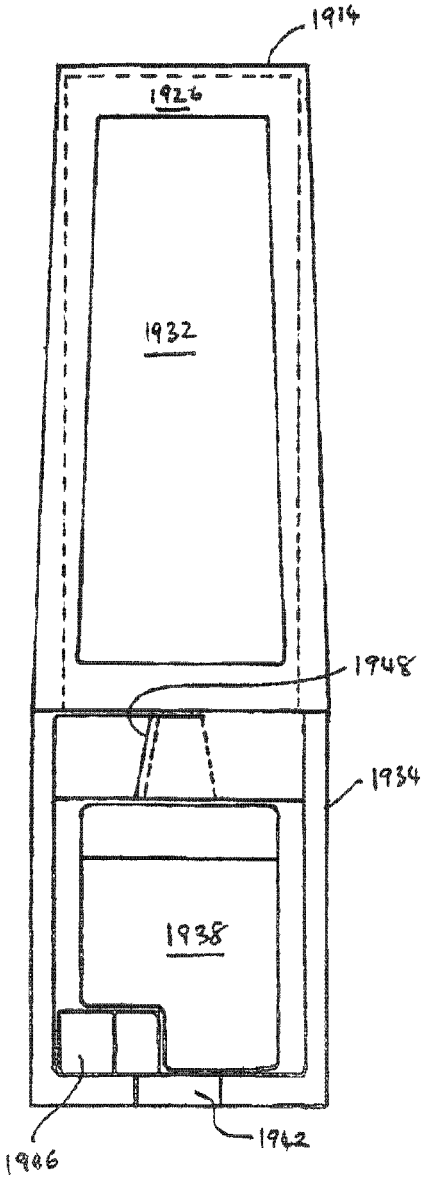
FIG. 24 is a front view of one of two identical clamping parts of the clamp shown in FIG. 20 and is aligned vertically with FIG. 23.
Figure 25A:
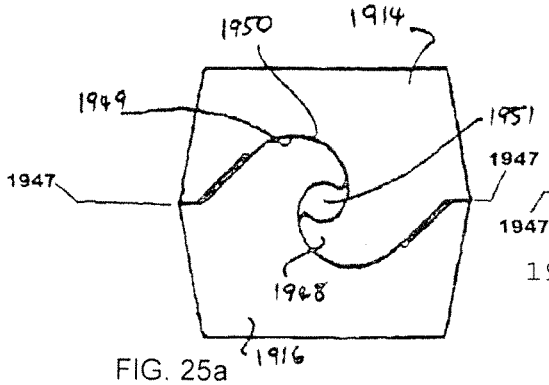
Figure 25B:
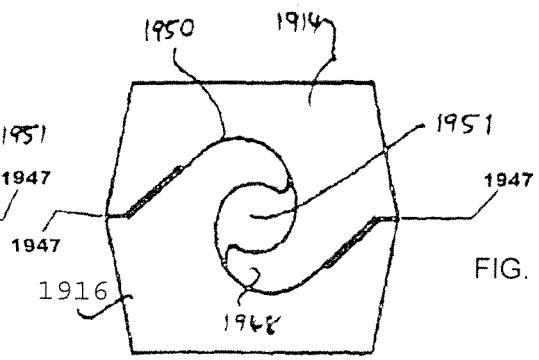
Figure 25D:
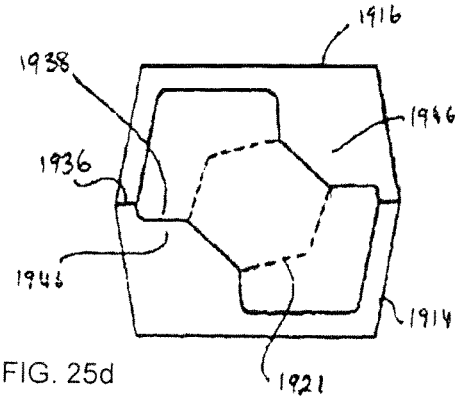
Figure 25C:
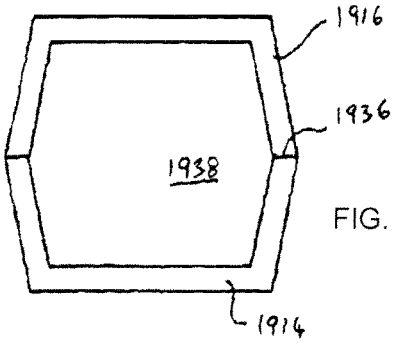
Figure 25E:
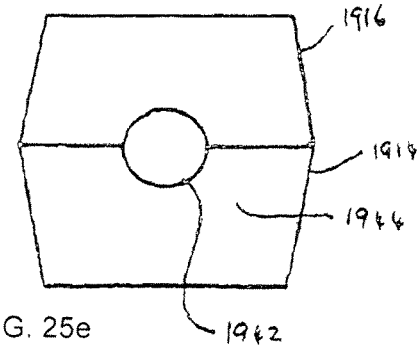
Figure 29A:
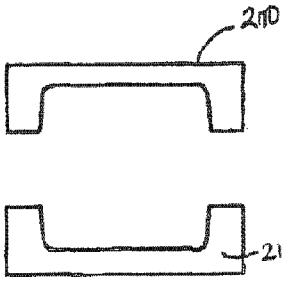
Figure 29B:
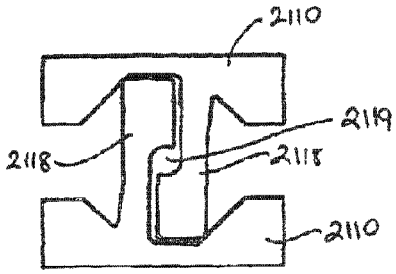
Figure 29C:
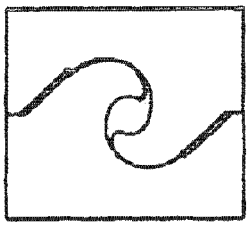
Figure 29D:
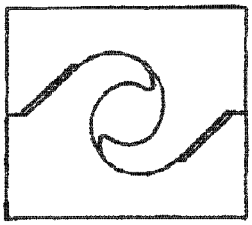
Figure 29E:
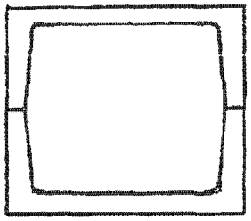
Figure 29F:
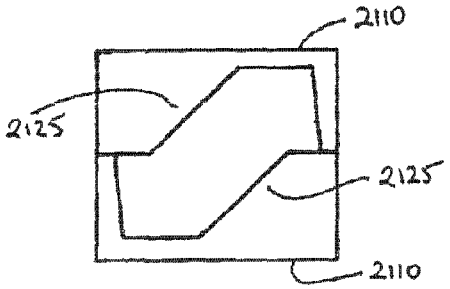
Figure 29G:
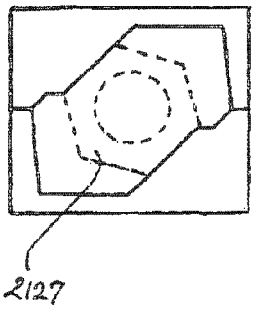
Figure 29H:
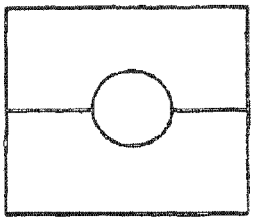
Figure 30:
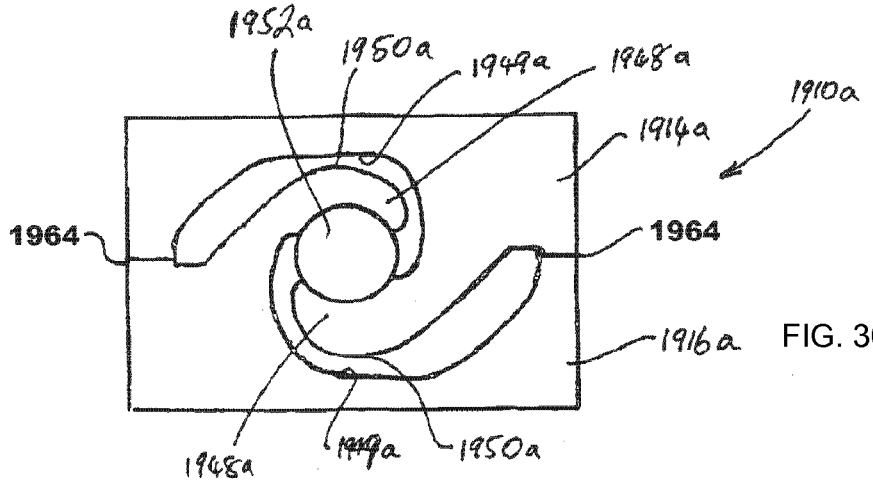
Figure 31:
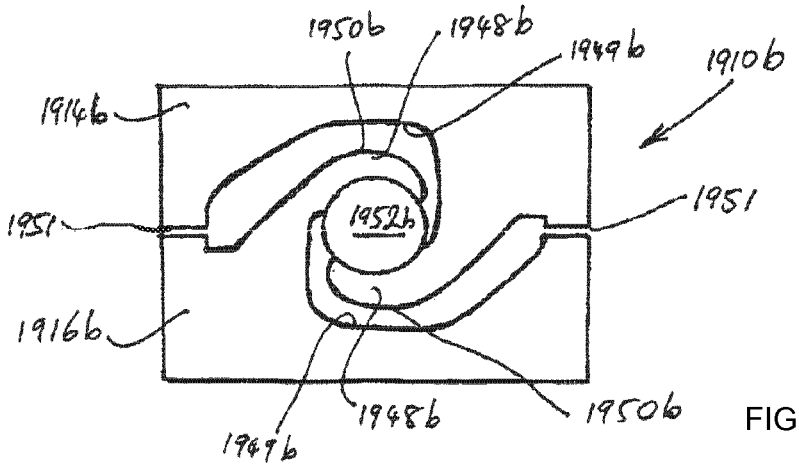
Figure 43:
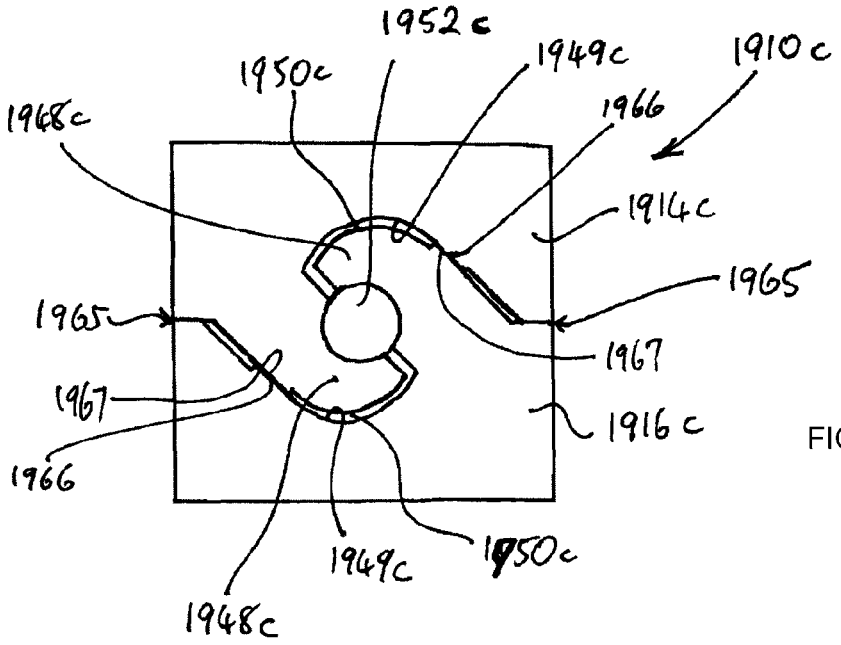
Figure 44:
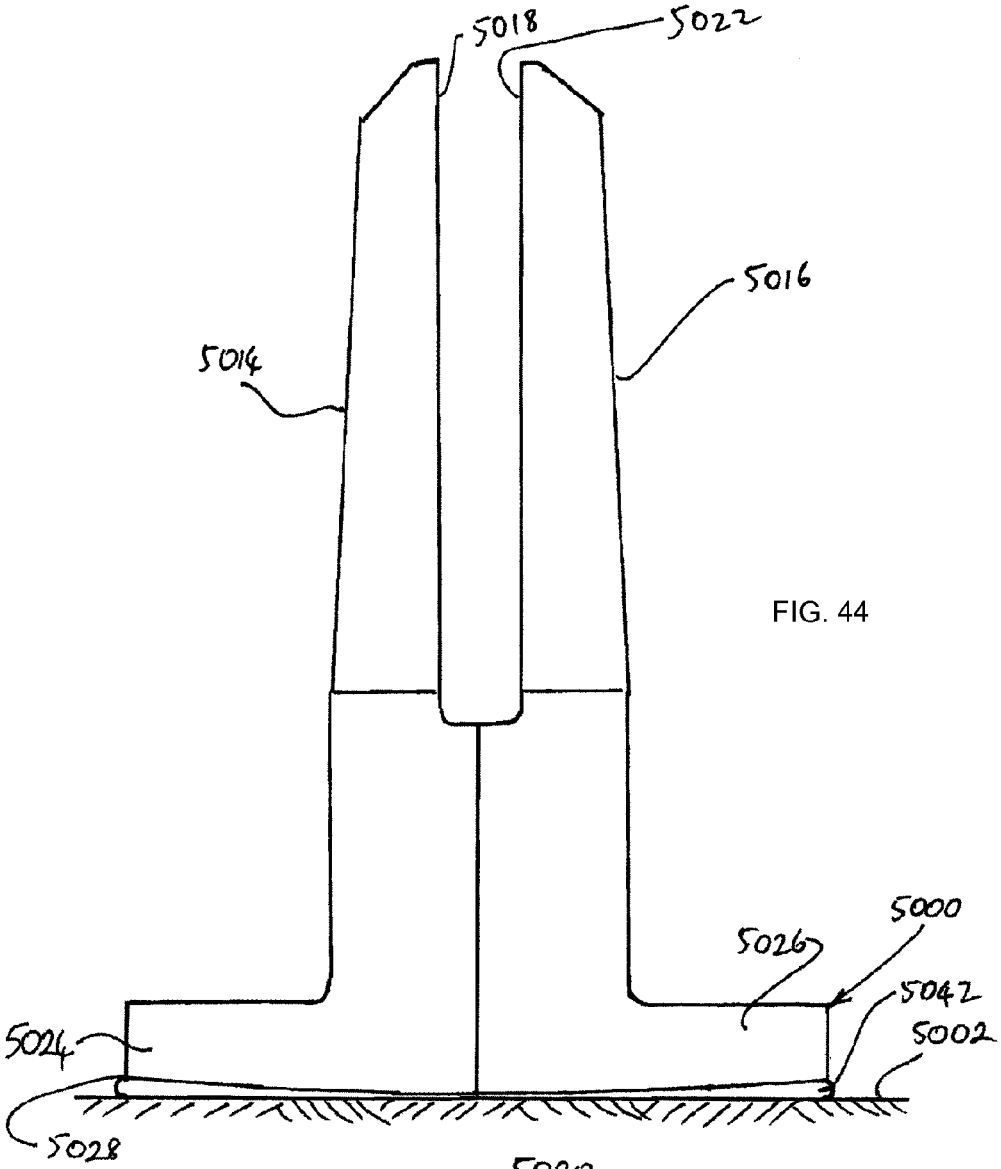
Figure 45:
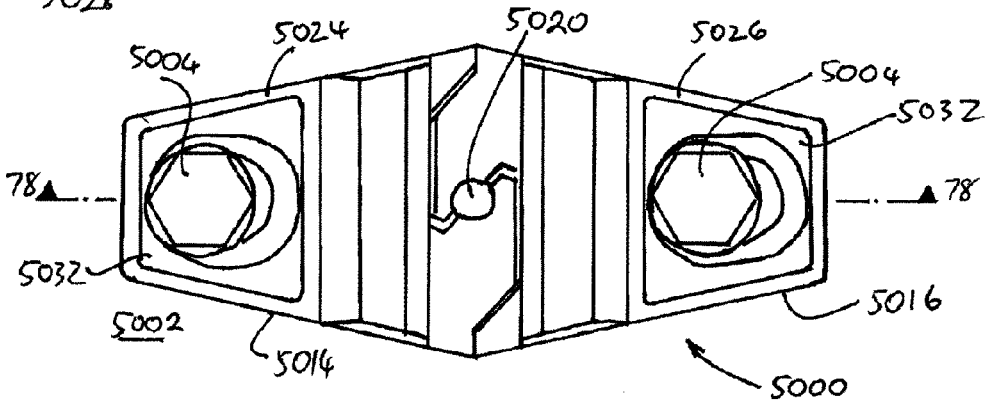
Figure 46:
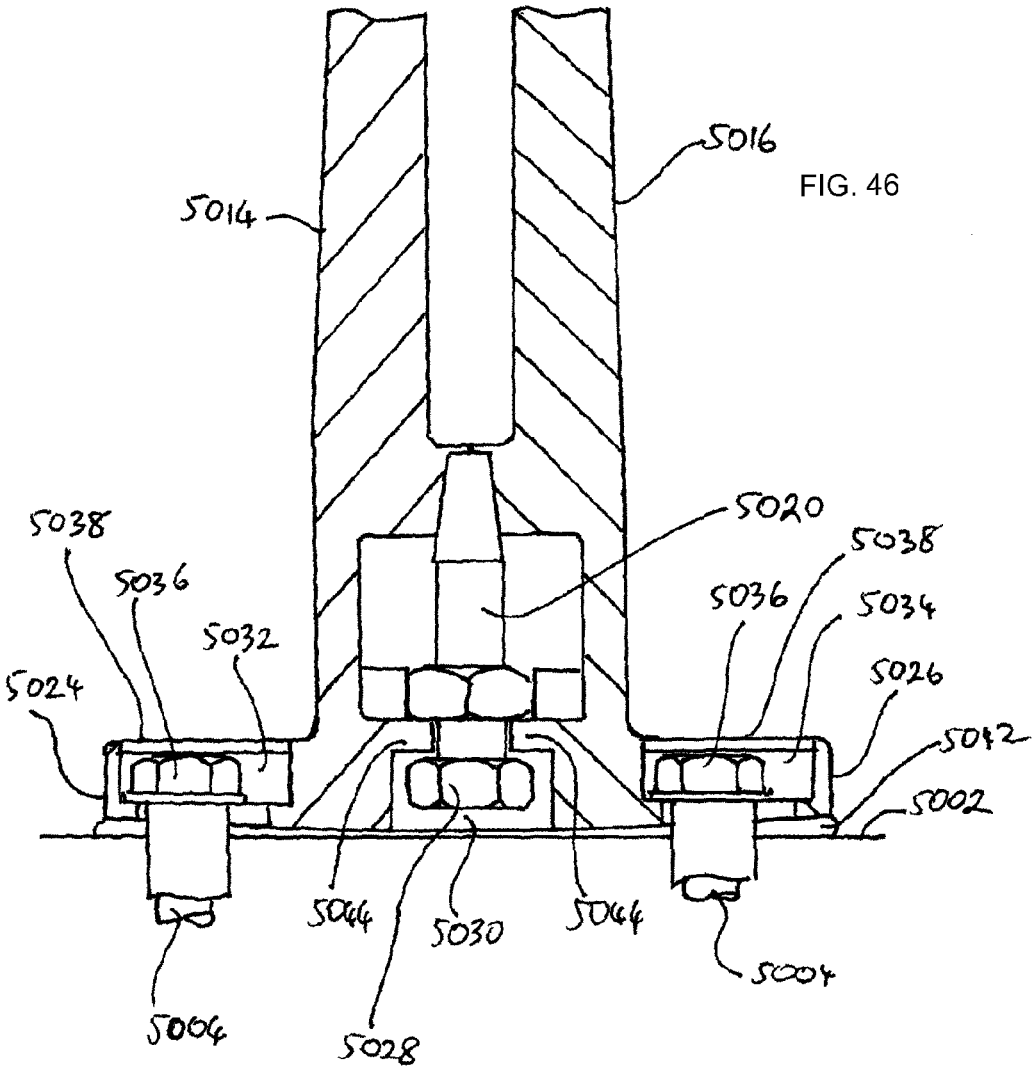
Figure 47:
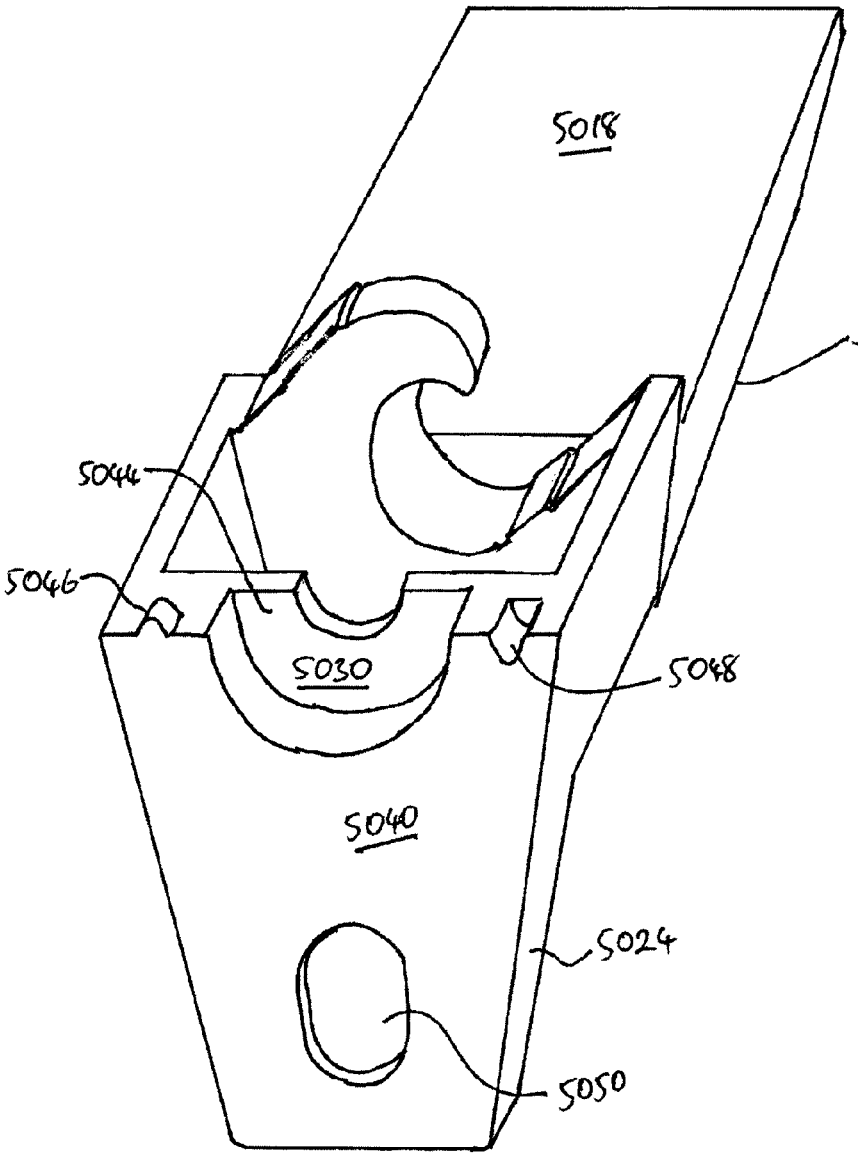
Figure 50:
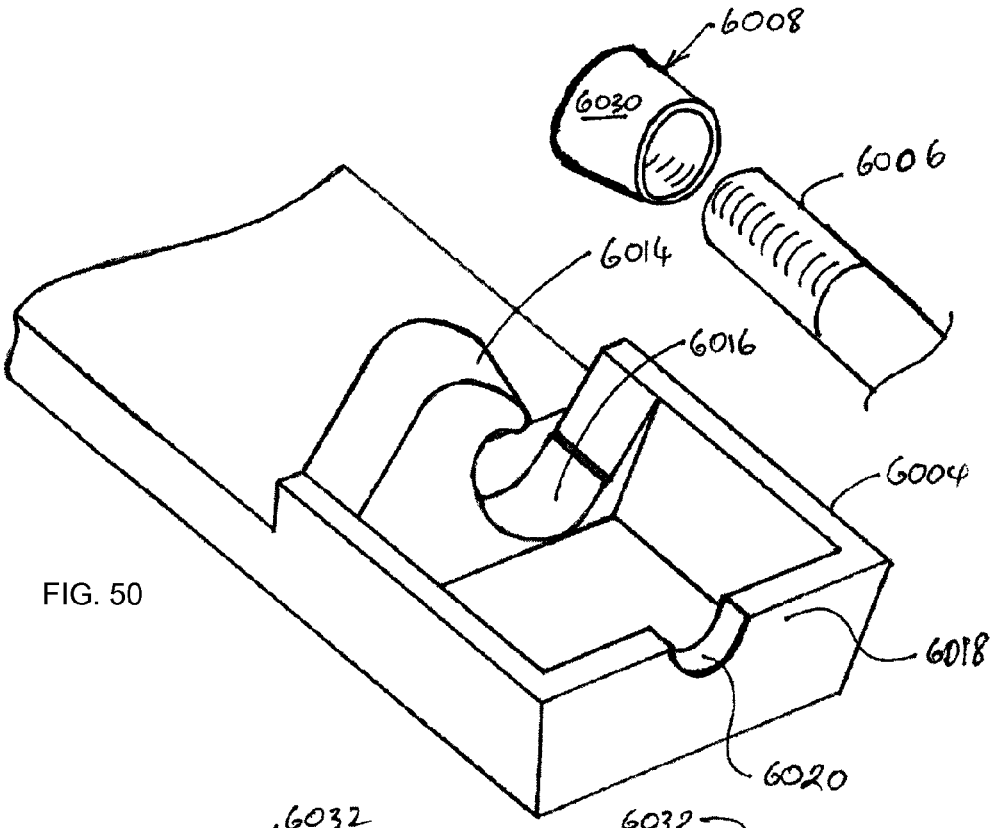
Figure 49:
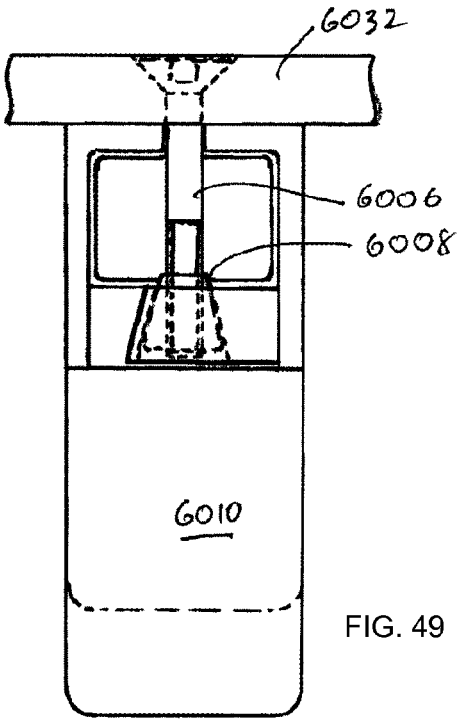
Figure 48:
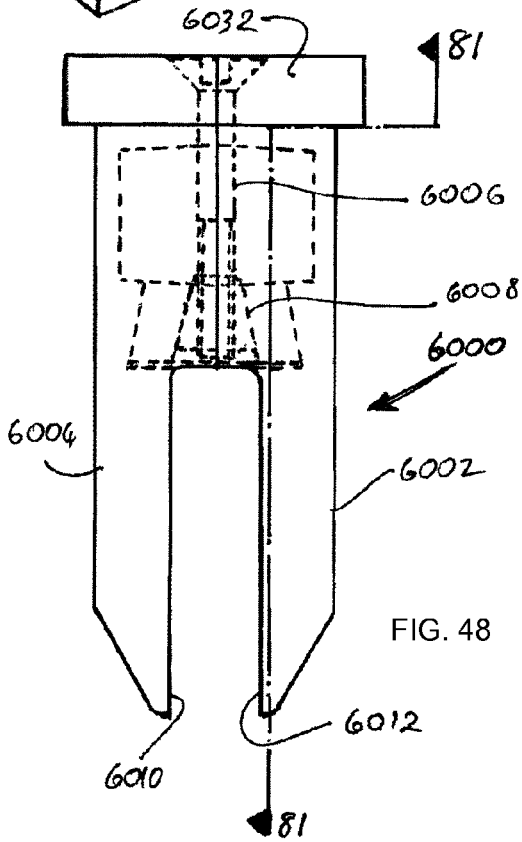

FIG. 25 comprises five cross-sections marked (a)-(e) of the clamping part shown in FIG. 24, the sections being taken at the stations marked (a), (b), (c), (d) and (e) respectively extending between FIGS. 23 and 24;

FIG. 26 is a side view showing some hidden lines of a further clamp according to the invention that is a modification of the clamp shown in FIG. 23;

FIG. 27 is a front elevation of one of two identical clamping parts of the clamp shown in FIG. 26;

FIG. 28 is a side view of an upper part only of a nut/bolt assembly adapted for use in the clamp shown in FIG. 27;

FIG. 29 is a set of cross-sections (a)-(h) of the two clamping parts shown in Figure the sections being taken at stations (a)-(h) respectively in FIG. 27;

FIG. 30 is a cross section through a modified version of the clamp shown in FIG. 26, the section being equivalent to that of FIG. 25(*b*);

FIG. 31 is a cross section (not to scale) through a further modified version of the clamp shown in FIG. 26, the section being equivalent to that of FIG. 25(*b*);

FIG. 32 is a perspective view of a first part of a further clamp according to the invention;

FIG. 33 is a perspective view of a second part of the clamp whose first part is shown in FIG. 32;

FIG. 34 is a perspective view of a first part of yet another clamp according to the invention;

FIG. 35 is a perspective view of a second part of the clamp whose first part is shown in FIG. 34;

FIG. 36 is a plan view of the clamping parts shown in FIGS. 32 and 33, part assembled;

FIG. 37 is a plan view of the clamping parts shown in FIGS. 32 and 33, now assembled;

FIG. 38 is a front elevation of the clamp part shown in FIG. 34 mounted to a structure;

FIG. 39 is a front elevation of the clamp part shown in FIG. 35;

FIG. 40 is a side view of the clamp whose parts are shown in FIGS. 34 and 35, now assembled;

FIG. 41 is a plan view of the clamp parts shown in FIGS. 34 and 35 partly assembled;

FIG. 42 is a plan view of the clamp parts shown in FIGS. 34 and 35, now assembled;

FIG. 43 is a cross section through a modified version of the clamp shown in FIG. 26, the section being equivalent to that of FIG. 25(*b*);

FIG. 44 is a side view of a further clamp according to the invention, secured to a surface;

FIG. 45 is a plan view of the clamp shown in FIG. 44;

FIG. 46 is a cross-sectional view of the clamp shown in FIG. 45, the section being taken at station "78-78";

FIG. 47 is a perspective view of one part of the clamp shown in FIG. 44;

FIG. 48 is a side view of a yet further clamp according to the invention secured to a structure;

FIG. 49 is a view taken at station "81-81" of the clamp as shown in FIG. 48, with one clamp part omitted;

FIG. 50 is a perspective view of portions of one clamping part and certain other components of the clamp shown in FIG. 48.

DETAILED DESCRIPTION OF PREFERRED EMBODIMENTS

Several clamps according to the invention will be described below that are suitable for use as the clamps 4 in fence 1, using glass, transparent plastics or other sheet-type materials for the panels 2. Their applicability to other fence types and similar applications will also be discussed. Purely for convenience, glass panels only will be discussed, but this is not intended to imply any limitation on the panel materials to which any of the clamps may be applied.

An important class of extra but related application for at least some of the clamps to be described is to the securing of hand- and other rails to panels of glass and other materials of balustrades and the like.

FIG. 2 is a schematic cross-section of a prior art clamp 10 and FIGS. 2 to 7 are corresponding schematic cross-sectional views intended to show in a simple way how clamps within the scope of the present invention operate. All details of arrangements for mounting the clamps to a substrate or structure are omitted from FIGS. 2 to 7. Other diagrams referred to below show practical realizations of the principles illustrated by FIGS. 2 to 7. In each of FIGS. 2 to 7, the section is taken on a plane perpendicular to an edge of a panel 12 to which the clamp in question is secured.

Refer firstly to FIG. 2 and to publication WO 03/091516 in which it is described in detail. Clamp 10 has two clamping parts 14 and 16 secured rigidly by screws 18 to a middle portion 20. Panel 12 is held between the two clamping parts 14 and 16, with packers 22 between panel 12 and the clamping parts 14 and 16. Screws 24 pass through clamping parts 14 and 16 and holes 26 in panel 12.

The clamping forces applied to the panel 12 (presuming it to be comparatively rigid) will depend on the thickness and elasticity characteristics of packers 22 and the thickness of panel 12, because the assembly of parts 14, 16 and 20 is substantially rigid and packers 22 are compressed during clamping. The screws 24, at least, are externally visible in clamp 10, which is undesirable.

FIG. 3 shows in a schematic view comparable to FIG. 2 a clamp 30 and panel 32 illustrating one way provided by the present invention to avoid the use of externally visible screws. Clamp 30 has clamping parts 34 and 36, and these have formations 38 and 9 respectively with holes 42 and 44 respectively therethrough. A locating component 46, such as a pin or screw, is close-fittingly received in the holes 42 and 44. Assembly of clamp 30 involves entering component 46 into holes 42 and 44 from below (as drawn, and as shown by arrow 48). Clamping parts 34 and 36 are thus held at a fixed spacing and if the combination of compressible elastic packers 50 and panel 32 have an uncompressed total thickness greater than the distance between parts 34 and 36, panel 32 will be clamped. As with clamp 10, the clamping forces will depend on the degree of compression of packers 50 on assembly and the packers' elasticity characteristics.

Clamp 1310 described below operates in essentially the way described for clamp 30.

FIG. 4 shows in a schematic view comparable to FIGS. 2 and 3 a further clamp 60 according to the invention, clamping a panel 62. Clamping parts 64 and 66 correspond in function to clamping parts 34 and 36 of clamp 30. Part 34 has hook-like formations 68 and 70 and clamping part 66 has similar formations 72 and 74. Formations bear on an elongate locating component 78 that at assembly is positioned (by movement in the direction of arrow 80) to engage them. Component 76 is dimensioned so that it must be forced between components 68 and 72. That is, surfaces of components 68 and 72 that face component 76 must move away from each other. This in turn due to the hook-like geometry of formations 68 and 72 tends to draw clamping parts 64 and 66 together, compressing elastic compressible packers 84 and so clamping panel 62.

However, at the same time, the effect of reaction forces applied by the panel 62 through packers 84 to the clamping parts 64 and 66 is that the clamping parts 64 and 66 actually tend to move towards each other in the region of formations 70 and 74, formations 68 and 72 acting as a fulcrum. Such movement is limited or prevented by formations 70 and 74 bearing on formations 82 of clamping parts 64 and 66. Formations 70 and 74 could actually be dispensed with altogether, with larger formations 82 bearing directly on component 76 or on each other. Clamp 1104 described below exemplifies a clamp that operates in the way described above for clamp 60.

FIG. 5 shows in a schematic view comparable to those of FIGS. 2, 3 and 4, a clamp 90 that can allow for the clamping force applied to a panel 92 to be adjusted by a user, or in alternative embodiments to provide for clamping faces to be held at a fixed and non-adjustable spacing.

Clamping parts 94 and 96 of clamp 90 have hook-like formations 100 and 102 near panel 92. Positioned in a space between formations 100 and 102 is a tapered part 104 of a locating component 106. The further upward (as drawn) that component 106 is moved, the more that surfaces of formations 100 and 102 facing element 104 are urged apart and therefore the more clamping parts 94 and 96 are urged towards each other and into clamping engagement with panel 92 and packers 98. Component 106 is threaded and engages with a nut 108 held non-rotatingly captive between parts 94 and 96 so that rotation by a user of component 106 moves it in the direction of arrow 110 and by such rotation allows adjustment of the relative positions of, and clamping forces applied by, clamping parts 94 and 96.

As with clamp 60 there is a tendency of the bottom ends (as drawn) of clamping parts 94 and 96 to move inward in use of the clamp 60, and this is shown as being resisted by formations 112 of parts 94 and 96 bearing on component 106. Alternatively, larger formations 112 could bear on each other.

Clamp 1910 described below operates on the principle described above of clamp 90, and can be made to provide for adjustable clamping or for maintenance of fixed relative positioning of its clamping parts 1914 and 1916. The latter is believed to be more important in practice.

Figure 1:
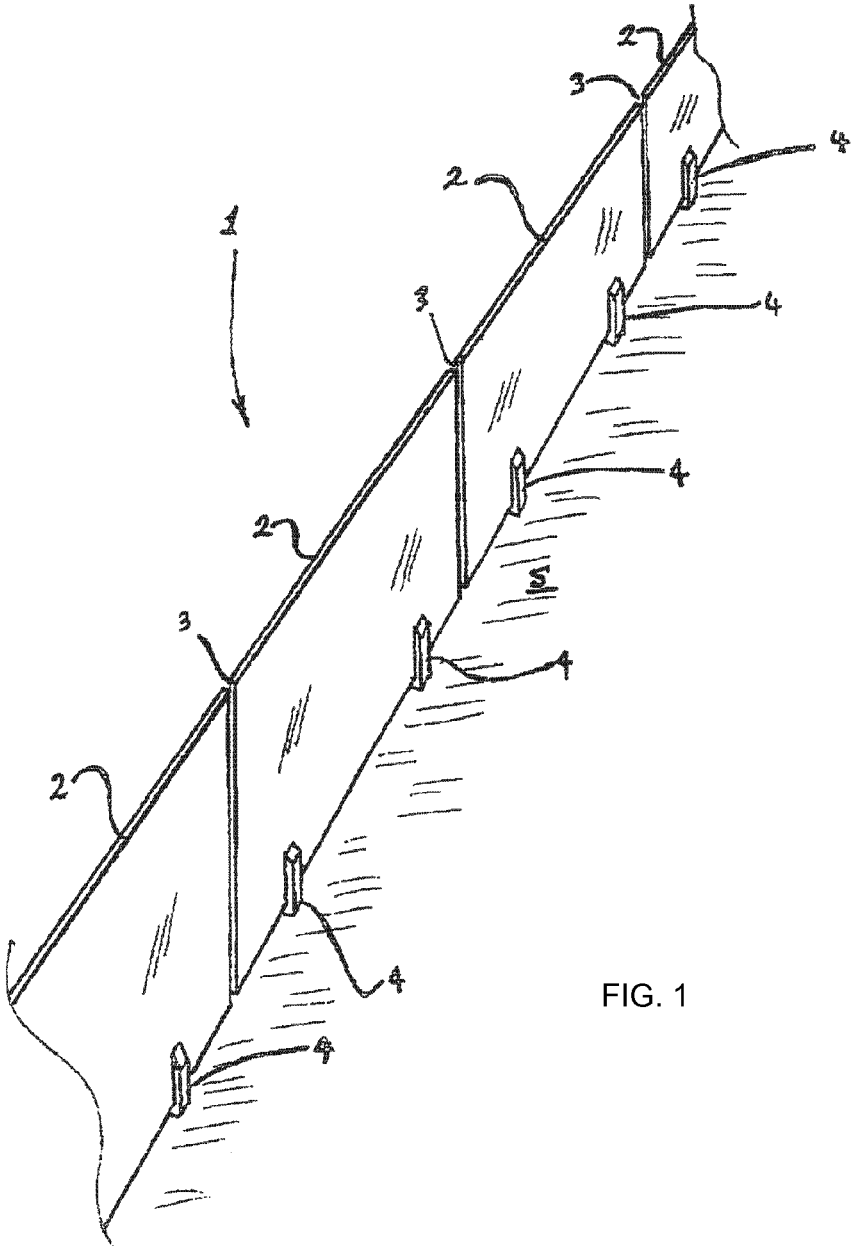
FIG. 1 is a perspective view of a portion of a fence having clamps of a type disclosed herein.
Figure 6:
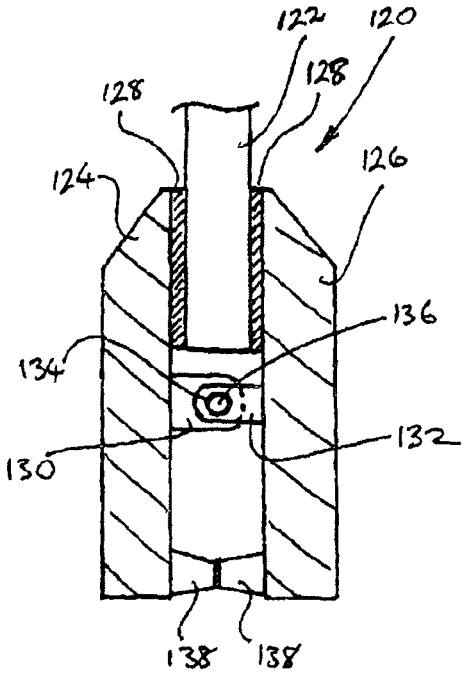
FIG. 6 is a schematic cross-section, taken on a plane perpendicular to the plane of a panel, of that panel and a fourth clamp according to this invention secured thereto.

Each of clamps 30, 60 and 90 avoids having externally visible fasteners (or the like) by providing for a locating component to be assembled to two clamping parts by being moved in a direction that is perpendicular (or could be at least approximately so) to an edge of the panel being clamped, and in (or at least approximately in) the plane of the panel. However, FIG. 6 shows, in a schematic view comparable to FIGS. 2 to 5, a clamp 120 that differs in this respect.

Clamp 120, shown clamping a panel 122 held between compressible elastic packers 128, has clamping parts 124 and 126 and these in turn respectively have several overlapping lugs 130 and 132 with holes 134 in each that in use of the clamp register with each other so as to receive a locating component (eg a pin or dowel) 136. At bottom ends (as drawn) of parts 124 and 126, formations 138 abut each other to limit or prevent inward movement of bottom ends of the clamping parts 124 and 126.

Clamp 120 may operate in two ways. In a first way, component 136 is not tapered (for example a pin of constant diameter along its length). Holes 134 are positioned so that those in lugs 132 do not fully register with those in lugs 130 and so that component 136 has to be forced into position in all holes 134, thus drawing upper ends (as drawn) of clamping parts 124 and 126 towards each other, compressing compressible elastic packers 128 and so clamping the panel 122. No adjustment is available in this case.

Alternatively, component 136 may be tapered, and holes 134 may be suitably stepped in size and with defined by conical inwardly facing surfaces. Then, the degree to which component 136 is axially moved into the holes 134 may be made variable by a user and so provide a degree of adjustment of clamping force (through the degree of compression of packers 128) and the ability to accommodate a range of total thicknesses of the panel 122 and packers 128.

In clamp 120, locating component 136 (tapered on not) is elongate and in the assembled clamp 120 extends in a direction parallel (or could extend approximately parallel) to the edge 139 of panel 122. Although at least one of its ends would likely be visible, this arrangement is still much less obtrusive in this respect than that shown in FIG. 2.

Figure 7:
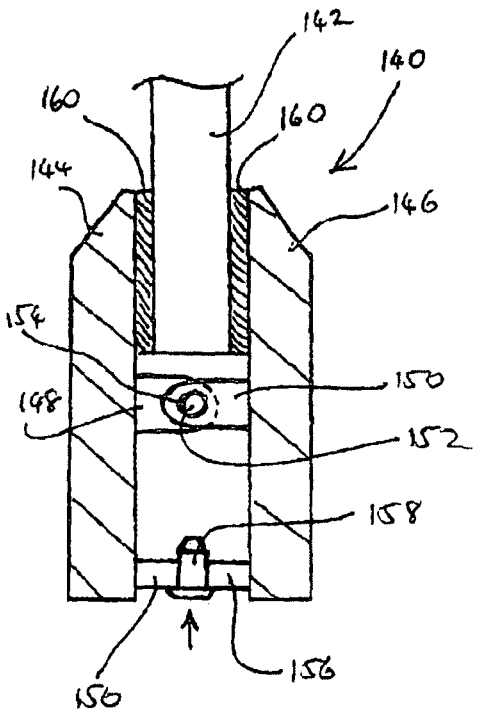
FIG. 7 is a schematic cross-section, taken on a plane perpendicular to the plane of a panel, of that panel and a fifth clamp according to this invention secured thereto.

FIG. 7 shows in a schematic view comparable to FIGS. 2 to 6, a further clamp 140 functionally similar in all but one respect to clamp 120. In clamp 140, lugs 148 on clamping part 144, lugs 150 on clamping part 146, and parallel pin 152 passing through holes 154 in lugs 148 and 150 act together as a hinge. A locating component 158 is positioned between formations 156 on or comprised in clamping parts 144 and 146 so as to urge upper ends (as drawn) of clamping parts 144 and 146 towards each other so as to clamp panel 142.

The pads or packers 50, 84, 98, 128 and 160 described above all play an important role in their respective clamps, both in at least partially determining the clamping force and in limiting or preventing damage to panels clamped in them. They need to be elastically (as opposed to plastically) compressible to a suitable degree to operate in the ways described herein, and preferably need to maintain their elasticity or resilience over time so that the clamp does not loosen its grip. Suitable grades of vulcanized natural rubber, synthetic rubber or rubber-like polymer materials may be used or more rigid plastics laminae. They may be secured to their respective clamping parts using suitable adhesives before clamp assembly. The term "clamping means" herein, including in the appended claims, refers (where a packer or pad is used) to the combination of the pad or packer and a clamping part. The remarks in this paragraph are equally applicable to the corresponding pads of other clamps disclosed below.

Practical clamps will now be described to illustrate the above operating principles.

Figure 8:
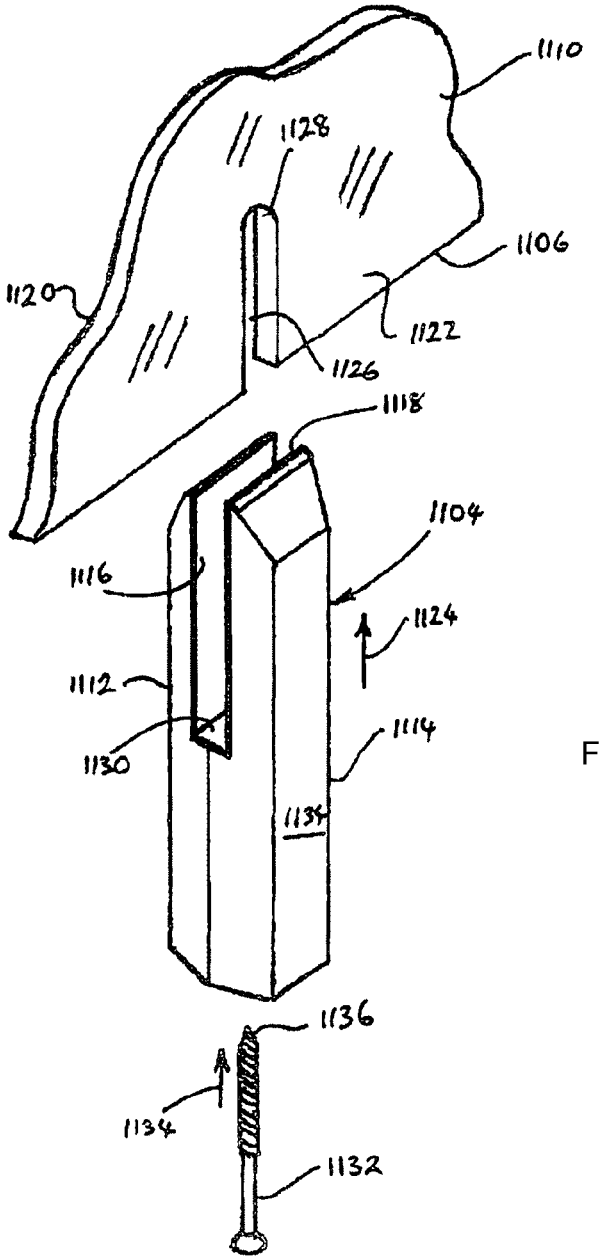
FIG. 8 is a perspective view of a clamp according to the invention, a pin to be comprised in the clamp and a glass panel, all positioned ready for assembly of the clamp onto the panel.

Referring to FIG. 8, there is shown a clamp 1104 in an upright position about to be secured at a lower edge 1106 of a glass panel 1110. With this done, clamp 1104 can be grouted into a hole (not shown) in ground substrate 1105 or otherwise secured to substrate 1105 or a structure.

Clamp 1104 has two main parts 1112 and 1114 that interlock with one another in a way described below. Secured to clamp part 1112 is a pad 1116 that when clamp 1104 is secured to panel 1110 bears on one 1120 of the panel's opposing faces. Secured to clamp part 1114 is a pad 1118 that when clamp 1104 is secured to panel 1110 bears on the other 1122 of the panel's opposing faces. Clamp 1104 is shown in a pre-installation condition when its two pads 1116 and 1118 although substantially parallel to each other are so spaced apart that clamp 1104 can be readily moved in the direction of arrow 1124 so as to engage with panel 1110, with panel 1110 in a gap 1131 between parts 1112 and 1114, with one pad 1116 adjacent to face 1120 and the other pad 1118 adjacent to face 1122.

Panel 1110 has a slot 1126 extending inwardly from edge 1106. Slot 1126 has a rounded end portion 1128 to limit any excessive tendency to cracking of panel 10. Interlocking sections 1150 of parts 1112 and 1114, described below, that lie between pads 1116 and 1118, are received in slot 1126. Edge 1106 of panel 1110 either is close to or actually rests on pads 1130 of which one is visible in FIG. 8.

With the clamp 1104 in place as described, its securing to panel 1110 is completed by driving an elongate screw 1132 into a gap 1164 between parts 1112 and 1114 in the base of clamp 1104, in the direction of arrow 1134. Screw 1132 has a tapered tip 1136 to ease its insertion into gap 1164. The effect of driving screw 1132 fully into gap 1164 is (as described below) is to push pads 1116 and 1118 progressively more firmly into contact with faces 1120 and 1122 of panel 1110 and to compress pads 1116 and 1118, thus developing friction between pads 1116 and 1118 and panel 1110. This friction holds clamp 1104 in place on panel 1110.

At least once screw 1132 is fully driven into gap 1164, the parts 1112 and 1114 hold pads 1116 and 1118 substantially parallel to each other.

Pads 1116 and 1118 are made of a suitable elastic material that can be compressed (so that the pad becomes thinner) by application of a force, and which requires continued maintenance of the compressing force in order to be kept compressed. Pads 1116 and 1118 may for example be formed form resilient elastic material such as vulcanized natural rubber, synthetic rubber, or suitable plastics or other polymeric materials. The use of such materials also tends to prevent scratching or other damage to panel 1110. Pads 1130, if used, may be made of a similar or the same material as pads 1116 and 1118.

Pads 1116 and 1118 may be adhesively or otherwise secured to 1112 and 1114 respectively or simply placed in position before clamp 1104 is moved into place on panel 1110.

Parts 1112 and 1114 may each be formed from an extrusion of a material such as a suitable metal (for example an Aluminum alloy), that is subsequently machined to remove some material. Screw 1132 may be of self tapping type adapted to cut into the extrusion metal as it is screwed into gap 64.

Other ways and other materials may be used to form parts 1112 and 1114 such as for example investment casting. If the material used is unsuitable for the use of a self-tapping screw such as screw 1132, a pin or dowel, not shown, preferably having a pointed forward end, may be used instead and pushed or hammered into gap 64.

In FIG. 8, parts 1112 and 1114 are shown as being so shaped that assembled clamp 1104 below gap 1132 simply has a substantially hexagonal horizontal cross-sectional shape and a flat bottom. This can be quite satisfactory for grouting into a hole, but other possibilities for assembled section shape and for securing in a hole or to a ground surface 1105 or structure will readily suggest themselves to persons skilled in the art once familiar with what is disclosed herein. For example, one could machine some horizontal serrations (not shown) into a lower portion of face 1134 of part 1114 that would key into the grout in a hole. A similar treatment could be applied to face 1136 of part 1112 (not visible in FIG. 8).

FIG. 9 shows at (a) a transverse cross-section of a constant-section elongate element 1136 (for example, although not essentially, an extrusion) from which parts 1112 and 1114 can be made. At (b) there is shown in transverse cross-section a second elongate constant-section body 1138 which is of identical transverse cross-sectional shape to body 1136. Body 1138 is shown in inverted orientation relative to body 1136, as when they are used respectively for parts 1114 and 1112 in the actual clamp 1104.

FIGS. 10 and 11 show elevations of a portion of body 1138 as seen looking in the direction of arrows "A" and "B" respectively.

Figure 14:
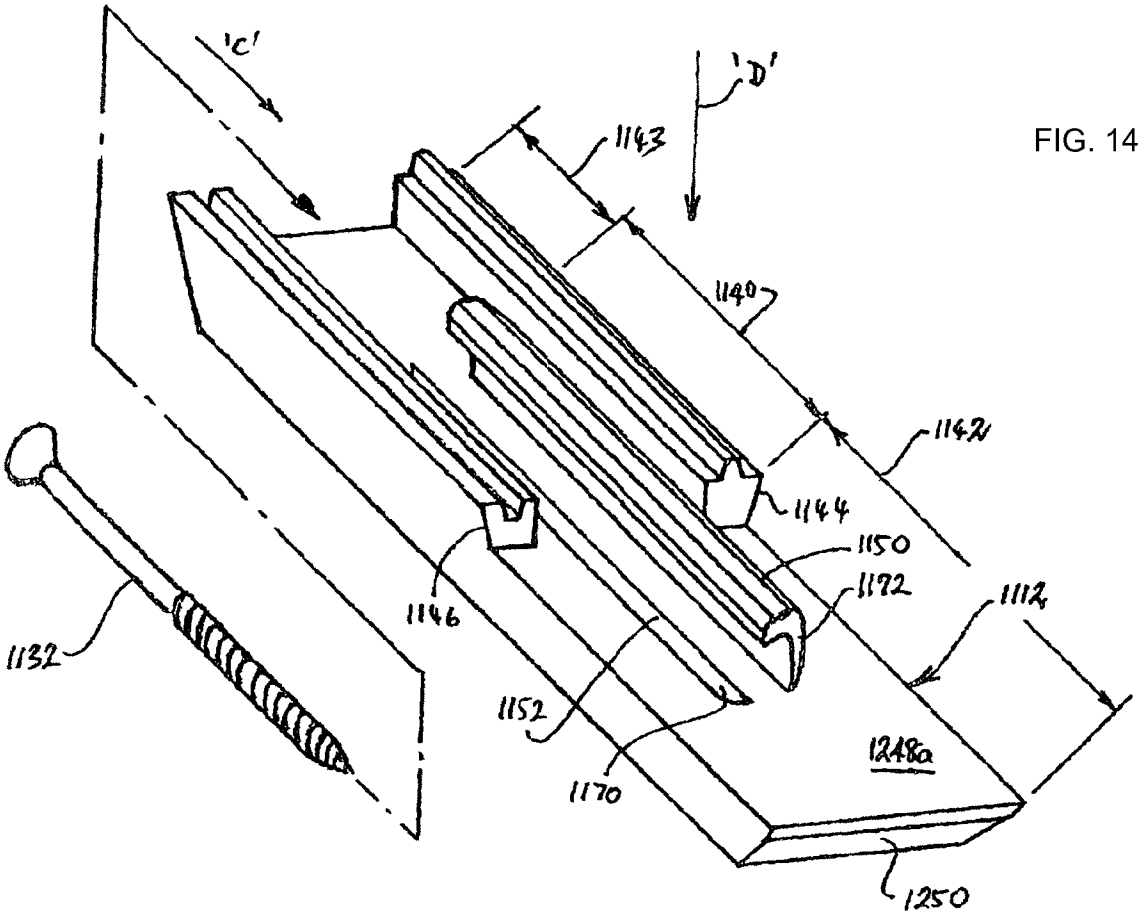
FIG. 14 is a perspective view of a clamp part and a pin of the clamp of FIG. 8.

FIG. 14 shows clamp part 1112 (which is in fact identical to clamp part 1114) as made from a length of body 1136. A first portion 1140 of part 1112 is of constant cross-section, as shown in FIG. 9(*a*) which shows body 1136 as seen looking in the direction of arrow 'C', being unchanged from body 1136. A second portion 1142 is defined firstly by removing upstanding formations 1144 and 1146 down to the level of co-planar flat surfaces 1248, 1253 and 1254 over the length of portion 1142 to define a single surface 1248 and secondly by removing some of formations 1150 and 1152 as shown. Pad 1116 (not shown in FIG. 14) in use lies against (and may be adhered to) surface 1248*a*. Pads 1130 (not shown in FIG. 14) if used, lie against and may be adhered to shoulders 1156 and 1158. A third portion 1143 is defined by removing parts of formations 1150 and 1152 down to the level of surface 1248*a*. This is done to keep screw 1132 reasonably short.

Although a beveled face 1250 is shown, this is merely an aesthetic choice and the construction of clamp 1104 without the use of eternally visible fasteners allows freedom of design.

Refer now to FIGS. 12 and 13. These show parts 1112 and 1114 partially and fully interlocking with each other and as seen looking in the direction of arrow "C" (FIG. 14). Transverse (as seen on the page) portions 1160 of the hook-shaped formations 1150 overlap each other laterally so that as parts 1112 and 1114 are moved towards each other they actually move apart-compare FIG. 13 (where parts 1112 and 1114 are as close together as they can get and FIG. 15 (where parts 1112 and 1114 are somewhat further apart overall).

FIG. 12 represents the relative positions of parts 1112 and 1114 before clamp 1104 is secured to panel 1110, i.e. as shown in FIG. 8. Gap 1164 between portions 1160 is small at this stage. As screw 1132 is screwed into gap 1164, parts 1112 and 1114 move towards the final positions shown in FIG. 13. In use of the clamp, panel 1110 and pads 1116 and 1118 are present between surface 1248 and its counterpart surface 1249 on part 1114, and pads 1116 and 1118 are compressed as screw 1132 moves into gap 1164, thus gripping panel 1110.

Formations 1144 and 1146 are arranged as shown so as to interlock fully when the two parts 1112 and 1114 are assembled together as shown in FIG. 13. They provide a degree of sealing against ingress of debris between parts 1112 and 1114 when they are assembled.

Note that formations 1150 and 1152, have rounded ends 1172 and 1170 respectively in portion 1142. As seen in FIG. 13, the formations 1150 and 1152 of the parts 1112 and 1114 are shaped to provide in combination with screw 1132 in gap 1164 essentially a solid body 1174 of rectangular cross-section with a rounded end formed by the ends 1170 and 1172. Body 1174 is received in round-ended slot 1126 of panel 1110 when clamp 1104 is secured thereto.

FIG. 16 shows a side view of an upper portion of the assembled clamp 1104 with pads 1116 and 1118 in place against surfaces 1248*a* and 1249.

FIG. 15 shows a view of part 1112 looking in the direction of arrow "D" (FIG. 14). Shown in position in FIG. 15 is a serpentine pad 1130 (which may be of a material like pads 16 and 18), that is placed (and preferably held by an adhesive) over the formation 1150. The pad 1130 and its counterpart (not shown) on part 1114 together cover the rounded end of body 1174 when clamp 1104 is assembled to prevent direct contact between glass panel 1110 and body 1174 and so limit the potential for damage and possibly local cracking.

Figure 17:
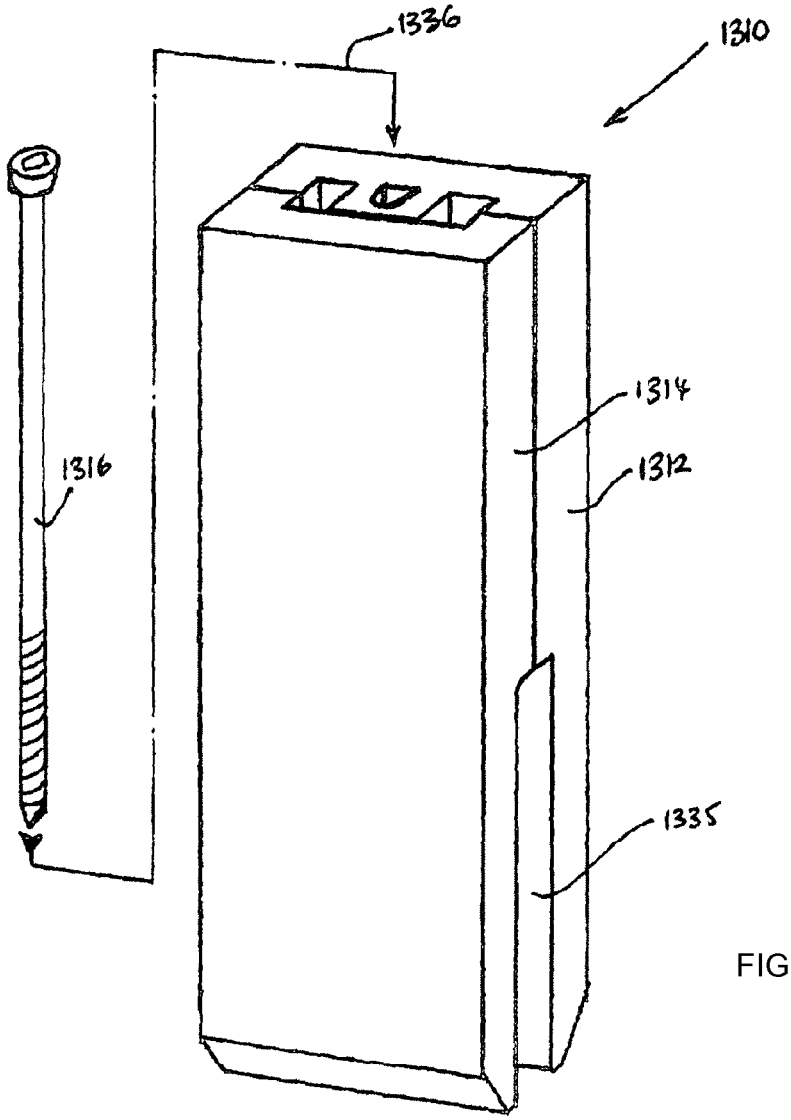
FIG. 17 is a perspective view of a further clamp according to the invention, with a screw component shown separately from the remainder of the clamp.
Figure 18:
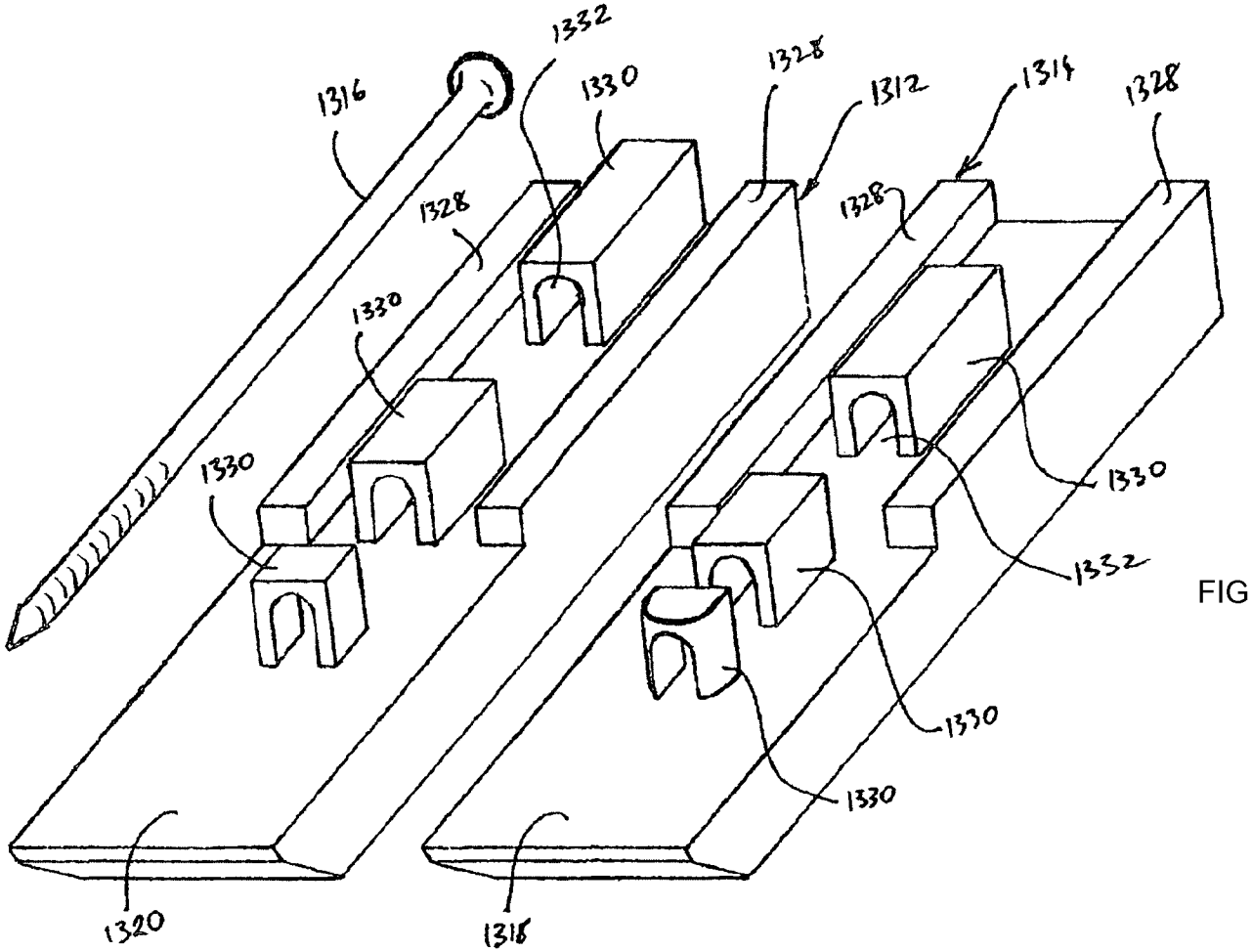
FIG. 18 is a perspective view of three components of the clamp shown in FIG. 17, shown separated.

FIGS. 17 and 18 show another clamp 1310, that operates similarly to clamp 1104. Clamp 1310 has two main components 1312 and 1314 that are held in engagement with each other, in positions relative to each other that provide clamping, partly by contact between them and partly by contact between each part and a further component 1316. Parts 1312 and 1314 have clamping faces 1320 and 1318 that in use are held substantially parallel to each other and against which elastic pads (not shown) preferably lie, when a glass panel is to be clamped. Clamp 1310 may be made by any suitable set of processes, but does lend itself to its parts 1312 and 1314 being made by machining of lengths of a suitable constant-cross-section body such as an extrusion 1322 in for example an Aluminum alloy.

Figure 19:
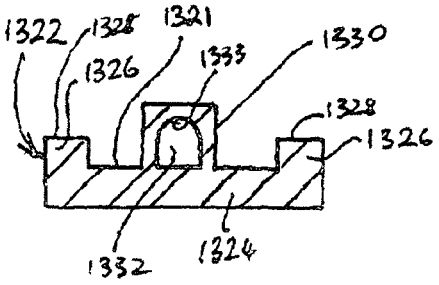
FIG. 19 is a transverse cross-section of an extrusion usable in manufacture of the clamp shown in FIG. 17.

FIG. 19 shows in transverse cross-section an extrusion 1322 (or other constant-section elongate body) from which both parts 1312 and 1314 may be made by machining. A base portion 1324 has a surface 1321 that on completion of clamp 1310 becomes surface 1320 (of part 1312) or surface 1318 (of part 1314) and upstanding side walls 1326 with surfaces 1328 parallel to surface 1320*a*. A further rectangular formation 1330 extends upward from surface 1321 and has an opening 1332 with a semicircular upper wall portion 1333. The opening 1332 is halfway across the width of body 1322. Body 1322 is so proportioned that If formation 1330 is removed from a length of body 1322 by machining it down to surface 1321, a second length of body 1322, not so machined, can be positioned facing the first one, with its surfaces 1328 in contact with the surfaces 1328 of the machined length, without the formation 1330 on the unmachined length contacting surface 1321 of the machined length.

To make parts 1312 and 1314, lengths (not shown) of body 1322 are machined to remove end portions of sidewalls 1326 and multiple portions of formation 1330 on each length are also removed down to their respective surfaces 1321. However, the positions and lengths of the portions of formation 1330 left unmachined are chosen differently for the two lengths of body 1322 so that the two parts 1312 and 1314 can be assembled together, facing each other with surfaces 1328 of one abutting surfaces 1328 of the other, without their respective formation 1330 remainders being in contact. The partial removal of sidewalls 1326 is such as to define a gap 1335 between parts 1312 and 114 in which a panel (not shown) to be clamped is receivable.

A screw 1316 may be passed through the aligned openings 1332 of the parts 1312 and 1314 to hold them together, as indicated by arrow 1336 in FIG. 17. The proportions of parts 1312 and 1314 are so chosen that for particular thicknesses of panel and elastic pads (not shown) in gap 1335, some compression of the pads is required when screw 116 is in position in openings 1332, thus ensuring a clamping effect. It is not essential that the faces 1328 of parts 1312 and 1314 be in actual contact in use of clamp 1310, but close proximity is preferred.

The unremoved portions of formations 1330 may include portions that lie in the gap 1335 and be received in a slot (like slot 1126 in panel 1110). Alternatively, there may by design be no unremoved portions of formations 1330 in gap 1335 if an unslotted panel is to be clamped.

Although a screw 1316 (which may be of self tapping type if parts 1312 and 1314 are formed from Aluminum alloy extrusions) has been disclosed, a pin or dowel may be used instead. These may be more difficult to remove.

Although clamps 1104 and 1310 have been described in terms of their method of construction from extrusions (or the like) it is emphasized that alternative methods of construction may be used as required, for example where different materials (such as stainless steel) are to be used.

There will now be described a clamp 1910 that uses the principle of two clamping parts (between which a panel may be clamped) that are held in relative positions for clamping by means of a further component that engages with both parts.

Figure 20:
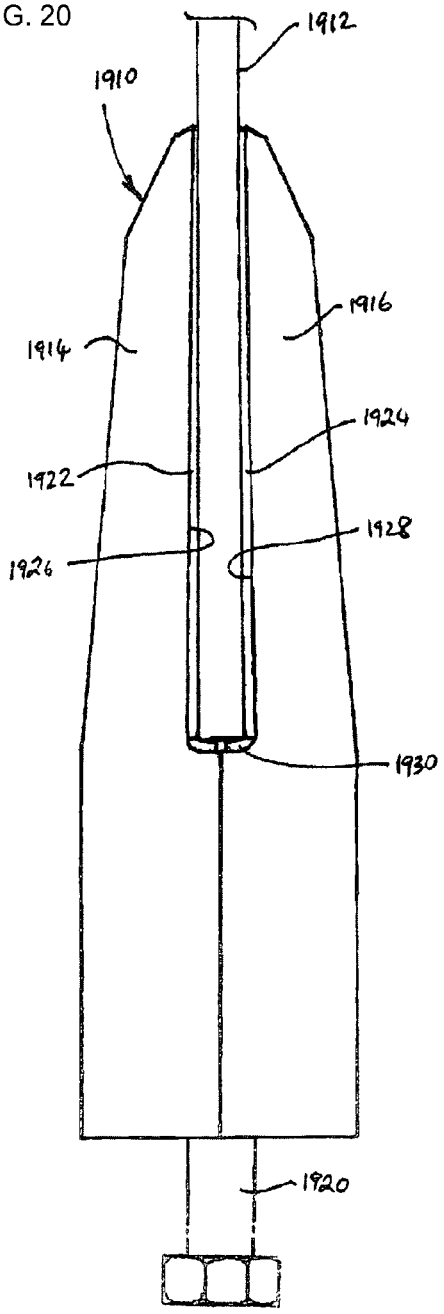
FIG. 20 is a side view of a further clamp according to the invention, supporting and clamping a glass panel.
Figure 21:
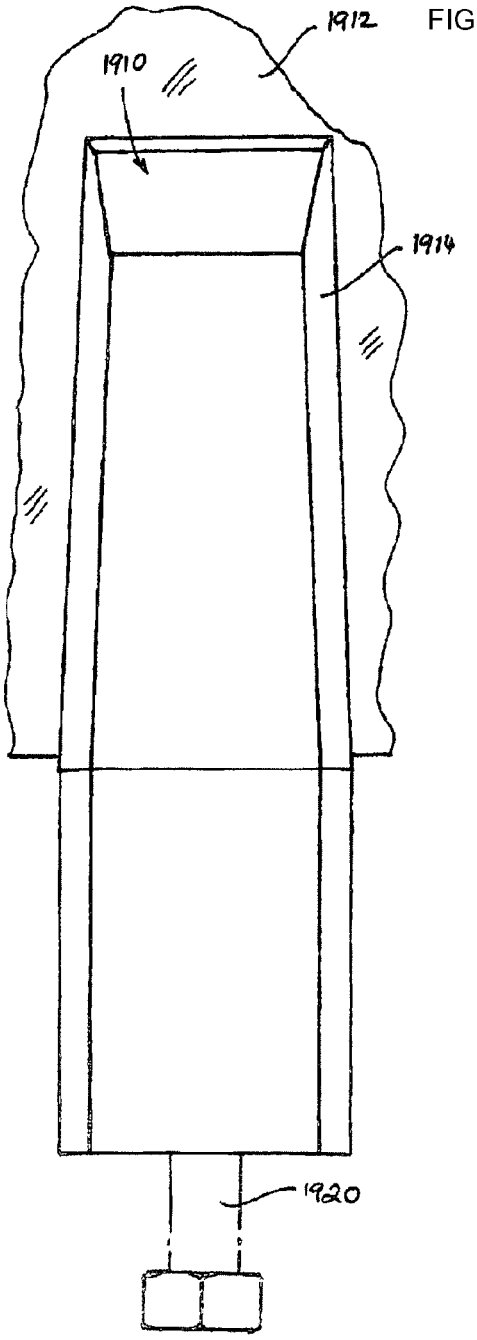
FIG. 21 is a front view of the clamp shown in FIG. 20.

FIGS. 20 and 21 show clamp 1910 assembled and supporting a glass panel 1912. Clamp 1910 has two identical clamping parts 1914 and 1916, and these are held together in use of clamp 1910 by a nut and bolt assembly 1918 of which only bolt 1920 is visible. Bolt 1920 may be used to secure clamp 1920 to a structure or to a suitable ground anchor (not shown), or its lower part (shown protruding in FIGS. 20 and 21) may itself have an anchoring function if clamp 1920 is grouted into a hole (not shown) in a ground mass (not shown) or the like.

Panel 1912 is held between elastic pads 1922 and 1924 that lie against opposing faces of panel 1912 and against clamping faces 1926 and 1928 of clamping parts 1914 and 1916 respectively. Below panel 1912 is an elastic pad 1930.

Figure 22:
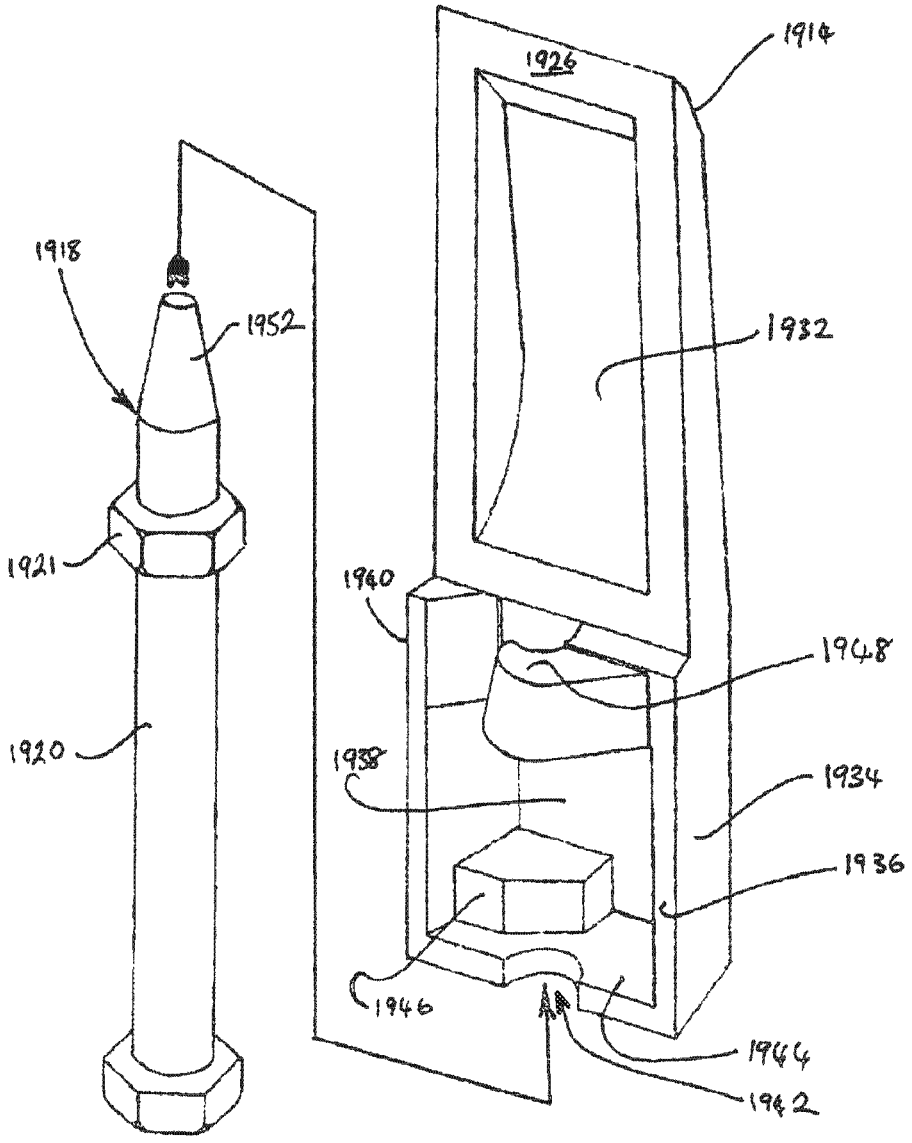
FIG. 22 is a perspective view of one of two identical clamping parts of the clamp shown in FIG. 20 together with a nut-and-bolt assembly of that clamp.

FIG. 22 shows clamping part 1914. A cavity 1932 is formed in an upper portion of clamping part 1914 to reduce the clamp weight and the quantity of metal required to make it, although cavity 1932 is optional. (Clamping parts 1914 and 1916 may be made by casting, possibly investment casting, in stainless steel or other suitable material, although this is not to preclude the possibility of other manufacturing methods being used).

A lower portion 1940 of clamping part 1914 has a face 1936 that on assembly of clamp 1910 faces the corresponding face of identical clamping part 1916. A cavity 1938 is defined within lower portion 1940. An approximately semicircular cutaway 1942 is defined in a bottom wall 1944 of lower portion 1940.

Within cavity 1938 there is a formation 1946 whose function when clamp 1910 is assembled is to prevent rotation of nut 1921 of assembly 1918. At the top of cavity 1938 a formation 1948 extends outward beyond face 1936. Seen from above, formation 1948 has a shape like a breaking wave, and a surface 1949 defines a wave-trough shape in front thereof, as can best be seen in cross-sections (a) and (b) of FIG. 25. (Note that these cross-sections are as seen by an observer looking downwards, as indicated by arrows on the dotted lines showing the sectioning stations (a)-(e) extending between FIGS. 23 and 24.

When clamping parts 1914 and 1916 are assembled together, the two formations 1948 nest together as shown in cross-sections (a) and (b) of FIG. 25, each of the two formations 1948 being received in the trough-like recess defined by a surface 1949 of the other part, and on assembly of clamp 1910 together define an approximately circular-section opening 1951 between them. Opening 1951 decreases in diameter from the bottom of formations 1948 to the top of formations 1948 so that when a tapered portion 1952 of bolt 1920 advances into opening 1951 those parts of formations 1948 on opposite sides of portion 1952 move in opposite directions thus pulling faces 1926 and 1928 towards each other (and therefore clamping therebetween the panel 1912).

To assemble clamp 1910, nut/bolt assembly 1918 is engaged in one of the clamping parts (1914 for example) with bolt 1920 passing through cutaway 1942 and the two parts 1914 and 1916 are then positioned one against the other, tapering porting 1952 being received between the two formations 1948. Nut 1921 is located between and against the two formations 1946 which prevent it rotating as bolt 1920 is screwed upward (in the orientation shown in the Figures). The result is that as formations 1948 are urged outwardly by taper section 1952, faces 1926 and 1928 are drawn together, compressing pads 1922 and 1924 and clamping panel 1912. An external locknut (not shown) may if required also be provided on bolt 1920, to be tightened against the outer surface of wall 1944.

To balance the tendency of the upper ends (i.e. the ends remotest from formations 1948) of parts 1914 and 1916 to splay outwards, there is in assembled clamp 1910 compressive contact between parts 1914 and 1916 at their lower ends and/or between parts 1914 and 1916 and bolt 1920 and/or between nut 1921 and formations 1946.

There are several schemes by which the interlocking of parts 1914 and 1916 described above can be achieved. A first scheme is shown in FIGS. 25 (*a*) and (*b*). Item number 1950 refers to an area on the "crest" of formation 1948. It is possible with suitable proportioning of parts 1914 and 1916 to arrange that area 1950 of one formation 1948 actually contacts the trough surface 1949 of the other part, so that once a certain degree of engagement of portion 1952 of bolt 1920 is achieved, the two parts 1914 and 1916 lock together. There may be gaps 1947 at the sides of the assembled clamp. With this scheme, the spacing between faces 1926 and 1928 can be very precisely specified and held, so that overtightening of the clamp on panel 1912 can be avoided.

FIG. 30 shows a section through a clamp 1910*a* having parts 1914*a* and 1916*a* corresponding to parts 1914 and 1916 of clamp 1910. (Similarly, an item number in FIG. 30 with a suffix "a" denotes a part equivalent to an element of clamp 1910 with the same item number excluding the "a".) FIG. 30 is directly equivalent to FIG. 25(*b*) although not to scale. Clamp 1910*a* has a different interlocking arrangement, inasmuch as each surface 1950*a* remains clear of adjacent surface 1949*a*. Bolt portion 1952*a* pushes formations 1948*a* apart, but movement together of parts 1914*a* and 1916*a* ceases when there is contact at points 1964. In this scheme, formations 1948 are subject to bending stress once the clamp 1910*a* is assembled, and parts 1914*a* and 1916*a* press against each other at points 1964. As with clamp 1910, the spacing of the clamping faces (not shown) can be precisely specified and held.

FIG. 31 shows a section through a clamp 1910*b*, with a third interlocking scheme. Clamp 1910*b* is generally the same as clamps 1910 and 1910*a* except for its interlocking scheme, and the suffixes "b" indicate parts corresponding to equivalent parts similarly numbered (except without the "b") in the description of clamp 1910. In this interlocking scheme, portion 1952*b* pushes formations 1948*b* apart as before, but surfaces 1949*b* and 1950*b* remain apart upon assembly and also there are gaps 1951 between parts 1914*b* and 1916*b*. In this scheme, the distance between the clamping faces is not precisely set, but instead the clamping force on a panel such as 1912 held between parts 1914*b* and 1916*b* depends on the distance to which bolt portion 1952*b* enters into the space between formations 1948*b*. This arrangement is not preferred.

FIG. 43 shows a section through yet another clamp 1910*c*, with a fourth interlocking scheme. Clamp 1910*c* is generally the same as clamps 1910, 1910*a* and 1910*b* except for its interlocking scheme, and the suffixes "c" indicate parts corresponding to equivalent parts similarly numbered (except without the "c") in the description of clamp 1910. In this interlocking scheme, portion 1952*c* pushes formations 1948*c* apart as before, and surfaces 1949*c* and 1950*c* remain apart. However, surfaces 1966 on the formations 1948*c* and surfaces 1967 abut each other, together with surfaces 1965. This scheme leaves formations 1948*c* under bending stress when portion 1952*c* is fully home, but this is believed acceptable for such materials as stainless steel (for example) which do not exhibit significant creep over time and under load. It is believed that the scheme assists in providing smooth sides in the assembled clamp without a "bump" due to misalignment of parts 1914*c* and 1916*c* where they meet at faces 1965 and (given reasonable attention to accuracy in manufacture) without any gaps between faces 1965 not abutting. This scheme is preferred by the applicants over the three discussed above.

FIG. 26 shows an assembly of two identical clamping parts 2110 for a clamp (not shown in its entirety) that is a modification of clamp 1910. FIG. 27 is a front elevation of clamping part 2112. FIG. 28 shows part only of a nut/bolt assembly 2114 usable with clamping parts 2112 and 2114. Parts 2112 and 2114 can be made to cooperate with assembly 2114 in essentially any chosen one of the ways parts 1914 and 1916 can cooperate (see above) with assembly 1918 of clamp 1910, but with one important difference. Each of clamping parts 2110 and 2112 has an elongate formation 2118 extending into the gap 2116 in which a panel (not shown) can be clamped using parts 2110 and 2112, and that would in use be received in a slot (not shown) like slot 1126 of panel 1110. The shape of the two formations 2118, and the way they interact with each other when the clamping parts 2110 and 2112 are assembled together is shown in cross section (b) of FIG. 29. On horizontal cross-section (in the clamp orientation shown) the formations are hook shaped and interact to define a space 2119 between them. Assembly 2114 is essentially the same as assembly 1918 of clamp 1910, except that it has an extension 2121 from tapered bolt section 2120 (corresponding to section 1952 of assembly 1918) that in use is received in space 2119. As bolt 2122 advances to lock the two parts 2110 together, it also draws together (or prevents drawing apart of) upper portions of parts 2110. Thus a slotted panel may be securely held.

A further difference from the clamping parts 1914 and 1916 is that clamping parts 2110 have a horizontal wall 2125 adjacent (and in the orientation shown, above) formations 2126 which like formation 1946 of part 1914, prevent rotation of nut 2127 of assembly 2114. Walls 2125 prevent nut 2127 from moving out of contact with formations 2126, which is undesirable as it can prevent effective assembly.

Clamp 1910 is unsuitable for some applications due to the protrusion of bolt 1920 from one end of the clamp. For example, persons without the skill or means to drill large holes in concrete slabs or the like to accommodate clamp 1910, may be able to drill bolt holes suitable for expanding bolts. For further example, it may be preferred to bolt a clamp operating on the principle of clamp 1910 to a deck or hand railing without reliance on the component (bolt 1920) that interlocks the two clamp parts. In these situations, clamp 5000 may be used. FIGS. 44 and 45 show a side view of clamp 5000 secured to a surface 5002 by bolts 5004. Clamp 5000 comprises two clamping parts 5016 and 5014, which interlock using a bolt 5020 in the same way as clamp 1910 (or, as desired, in any of the ways described by reference to FIGS. 30, 31 and 43). Accordingly the way the two parts 5014 and 5016 interlock and clamp a panel (not shown) need not be re-explained here. Clamp 5000 is shown in FIGS. 44 and 45 without cushioning pads which in practice would be used between faces 5018 and 5022 and the panel. Parts 5014 and 5016 have protruding flanges 5024 and 5026 positioned so as to be at a base end 5028 of assembled clamp 5000. Bolts 5004 play no part in the interlocking of parts 5014 and 5016 or in the actual clamping of a panel therebetween. For installation to a concrete slab for example, they could be expanding bolts or anchors of known type.

FIG. 46 is a cross-sectional view of clamp 5000 when assembled, and shows that bolt 5020 has its head 5028 received in a recess 5030 formed by the two parts 5014 and 5016, rather than protruding below base 5028. Thus bolt 5020 can be tightened into place to lock parts 5014 and 5016 together and clamp a panel, and the assembled clamp 5000 then bolted to a surface 5002 using bolts 5004.

The flanges 5024 and 5026 have recesses 5032 and 5034 in which bolt heads 5036 are received. For better appearance, cover plates 5038 may be provided to conceal bolt heads 5036. (Alternatively, simple platelike flanges which do not conceal bolt heads 5036 could be provided.)

Further optional features are shown on clamp 5000. Bolts 5004 pass through slots 5050 rather than round holes so that clamp 5000 can be moved transversely (relative to a clamped panel, not shown) before being tightened. Further, bottom faces 5040 of parts 5014 and 5016 are of part-cylindrical shape (as best seen in FIG. 44) so that base 5028 is itself part cylindrical and the angle of faces 5018 and 5022 to surface 5002 can be adjusted slightly. A compressible pad or shim 5042 is used between clamp 5000 and surface 5002. These adjustment features are believed more important to provide in applications where a clamp is to be secured to a surface compared to situations where a clamp can be grouted into a hole after being clamped to a panel.

FIG. 47 is a perspective view of one 5014 of the clamping parts comprised in clamp 5000. Because it is believed that bolt 5020 is less effective in locating the two halves 5014 and 5016 laterally than bolt 1920 of clamp 1910 due to proximity of its head 5028 to walls 5044, part 5014 has a tongue 5046 and a groove 5048 formed on opposite sides at its base. When clamp 5000 is assembled, these register with corresponding parts of part 5016 to provide enhanced lateral alignment at the base 5018 of clamp 5000.

FIG. 48 shows still another possible embodiment of a clamp that works in a similar way to clamp 1910 but with one important difference. Clamp 6000 has two identical clamping parts 6002 and 6004 (corresponding directly to clamping parts 1914 and 1916 of clamp 1910) that interlock with an assembly of a bolt or screw 6006 and a threaded ferrule 6008. Faces 6010 and 6012 of parts 6002 and 6004 respectively can be provided with cushioning pads (not shown) and a panel (not shown) can be clamped therebetween. A portion of clamp part 6002 is shown in FIG. 50. Clamp part 6002 has a wavelike formation 6014 and a trough-like recess 6016 and a basal wall 6018 with cutout 6020, so is similar to parts 1914 and 1916 of clamp 1910. However the taper of the wave 6014 and trough 6012 is in the opposite direction to the corresponding taper in clamp 1910. When parts 6002 and 6004 are assembled together in the way parts 1914 and 1916 are assembled together, the space between their respective wave formations 6014 and 6015 has a diameter that decreases with decreasing distance from the basal wall 6018. To urge wave formations 6014 and 6015 apart, a ferrule 6008 is placed between them. Ferrule 6008 has a conical outer surface 6030 and a coaxial female—threaded hole therethrough. Bolt or screw 6006 engages threadably with ferrule 6008 and extends through a hole formed by cutout 6020 and its counterpart in part 6002. As shown in FIGS. 48 and 49, bolt or screw 6006 can be received in a hole in a structural member 6032 and when it is turned in an appropriate direction can draw ferrule 6008 towards basal wall 6018, urging wave formations 6014 and 6016 apart and clamping a panel (not shown) between parts 6002 and 6004.

While clamp 6000 lends itself to applications where it is to be secured to a surface as shown, it could also be used in applications where it is for example grouted into a hole. In this case, a nut may be provided on the screw or bolt 6006 to bear on the external side of wall 6018 to enable movement of ferrule 6008 by the screw or bolt 6006.

Referring now to FIGS. 32 and 33 there are shown two clamping parts of a clamp 3000 made on the principle described by reference to FIG. 6. Clamp 3000 is suitable for use in for example supporting panels and handrails of balustrades. The following is a list of item numbers in FIGS. 32 and 33 and their corresponding item numbers in FIG. 6:

| FIG. 6 Item No. | FIGS. 64, 65 Item No. |
|---|---|
| 124 | 3124 |
| 126 | 3126 |
| 138 | 3138 |
| 130 | 3130 |
| 132 | 3132 |
| 134 | 3134 |

Holes 3134 are of the same size, and a constant-diameter pin or bolt 3150 can be passed through them so as to assemble the clamp 3130. Not shown in FIGS. 32 and 33 are elastic compressible pads corresponding to pads 128.

A mounting bolt for securing clamping part 3124 to a substrate or structure can be positioned between the items 3138 that are also marked "a", with the bolt head and a washer bearing on surface 3140. The arrangement shown allows the clamping part 3124 to be moved laterally as required for balustrade alignment during installation, before clamping part 3126 is offered up to it and the pin inserted.

FIG. 37 is a plan view of the clamping parts shown in FIGS. 32 and 33, now assembled.

FIG. 38 is a front elevation of the clamp part shown in FIG. 34 mounted to a structure 4000, which could be a deck or a hand railing for example.

FIGS. 34 and 35 show clamping parts 3224 and 3226 of another clamp 3220 on the same principle. Clamping parts 3224 and 3226 have holes 3234 (corresponding to holes 134 in FIG. 6) that are of varying sizes and defined by conical inwardly facing surfaces and so are suitable for the use of a tapered pin 3260 instead of a constant-diameter one.

Clamping parts 3224 band 3226 have a slightly different arrangement from 3124 and 3126 for installation of a bolt, but the principle is the same: there is a slot 3250 in which a mounting bolt 3254 can be received with the clamping part 3224 movable latrerally (i.e. in the direction shown by arrow 3252) as required during installation before clamping part 3226 is secured to it.

The arrangement shown whereby a mounting bolt is received in a slot (eg 3250) has a useful advantage in that it is easy to access the point where that bolt enters a structure on which the clamp is mounted so as to apply sealant (such as a silicone sealant) and then assemble the other clamping part.

FIG. 39 is a front elevation of the clamp part shown in FIG. 35. FIG. 40 is a side view of the clamp whose parts are shown in FIGS. 34 and 35, now assembled. FIG. 41 is a plan view of the clamp parts shown in FIGS. 34 and 35 partly assembled. FIG. 42 is a plan view of the clamp parts shown in FIGS. 34 and 35, now assembled.

Still other embodiments and variations, within the scope of the described invention, will in the light of the above description readily suggest themselves to persons skilled in the art.

The invention claimed is:

1. A clamp securable to a panel, the clamp comprising:

a first clamping member that comprises a first clamping surface;

a second clamping member that comprises a second clamping surface, wherein the second clamping surface faces the first clamping surface; and an elongate locating component whose length extends longitudinally in the clamp between the first and second clamping members; wherein:

firstly, the first clamping member comprises:

a first formation that extends toward the second clamping member and circumferentially partway around a tapered portion of the elongate locating component, wherein a first free ended portion of the first formation lies laterally on an opposite side of the elongate locating component from the first clamping surface; and two first sidewalls formed on opposing sides of the first formation and facing the second clamping member;

secondly, the second clamping member comprises:

a second formation that extends toward the first clamping member and circumferentially partway around the tapered portion of the elongate locating component, wherein a second free ended portion of the second formation lies laterally on an opposite side of the elongate locating component from the second clamping surface; and two second sidewalls formed on opposing sides of the second formation each second sidewall facing one of the first sidewalls comprised in the first clamping member; and thirdly, the tapered portion of the elongate locating component contacts the first and second formations between the respective free ended portions thereof, and when advanced longitudinally moves the first and second free ended portions between:

a first position, wherein the tapered portion is partially inserted between the free ended portions, such that first clearances exist between the first and second free ended portions and the second and first clamping members, respectively, and second clearances exist between mutually facing first and second sidewalls; and a second position, wherein further insertion of the tapered portion between the first and second free ended portions closes the second clearances while the first clearances remain unclosed.

2. The clamp according to claim 1 wherein the first and second clamping members contact at least one of each other and the elongate locating component at a first location in the clamp that is remote longitudinally from the first and second clamping surfaces; and the first and second formations are located at a second location in the clamp that is less remote longitudinally from the first and second clamping surfaces than the said first location in the clamp.

3. The clamp of claim 1 wherein the first and second formations overlap with each other longitudinally in a longitudinal direction of the clamp.

4. The clamp of claim 1 wherein the first and second clamping members are identical to each other.

5. The clamp of claim 1 wherein the clamp further comprises a nut held non-rotatingly captive between the first and second clamping members and with which a threaded section of the locating component is engaged, whereby the elongate locating component and the tapered portion thereof, when rotated, are movable longitudinally in the clamp.

6. The clamp of claim 1 wherein an end of the elongate locating component protrudes externally from the first and second clamping members.

7. The clamp of claim 1 wherein:

at least one of the first and second clamping members comprises a flange protruding therefrom generally in a direction that is perpendicular to the elongate locating component, the flange having an opening through which in use of the clamp a fastener for securing the clamp to a structure can be passed.

8. The clamp of claim 7 wherein the flange comprises a recess within which a head end of a fastener extending through the opening is receivable, and further comprising a cover that is close-fittingly receivable in the recess whereby to conceal the head end.

9. The clamp of claim 8 wherein an outer face of the cover in use lies flush with a surface of the flange.

10. The clamp of claim 1 wherein:

each of the first and second clamping members comprises a flange protruding therefrom generally in a direction away from and perpendicular to the elongate locating component, each flange having an opening through which a fastener for securing the clamp to a surface can be passed;

the clamp has an end surface longitudinally remote from the first and second clamping surfaces, the end surface comprising surfaces of the flanges;

an end of the elongate locating component is received within a recess in the end surface and the end surface is part-cylindrical; and the clamp further comprises a shim having firstly a surface curved identically to the end surface and secondly a flat surface.

* * * * *